US007753798B2

(12) United States Patent
Soltys et al.

(10) Patent No.: US 7,753,798 B2
(45) Date of Patent: Jul. 13, 2010

(54) SYSTEMS, METHODS, AND DEVICES FOR MONITORING CARD GAMES, SUCH AS BACCARAT

(75) Inventors: Richard Soltys, Mercer Island, WA (US); Richard Huizinga, Mercer Island, WA (US)

(73) Assignee: Bally Gaming International, Inc., Las Vegas, NV (US)

( * ) Notice: Subject to any disclaimer, the term of this patent is extended or adjusted under 35 U.S.C. 154(b) by 1400 days.

(21) Appl. No.: 10/934,785

(22) Filed: Sep. 2, 2004

(65) Prior Publication Data

US 2005/0137005 A1 Jun. 23, 2005

Related U.S. Application Data

(60) Provisional application No. 60/500,898, filed on Sep. 5, 2003.

(51) Int. Cl.
*A63F 9/24* (2006.01)
*A63F 1/14* (2006.01)

(52) U.S. Cl. ..... 463/47; 273/149 R; 273/149 P

(58) Field of Classification Search ..... 273/149 R, 273/292–293, 296, 148 R, 148 B; 463/1, 463/47, 48

See application file for complete search history.

(56) References Cited

U.S. PATENT DOCUMENTS 1,034,402 A 7/1912 Hardy
1,727,800 A 9/1929 Albert
1,890,504 A 12/1932 Ferguson, Jr.
2,663,418 A 12/1953 Grunwald ..... 206/62
2,694,662 A 11/1954 Hunter, Jr. ..... 154/121
3,222,071 A 12/1965 Lang
3,377,070 A 4/1968 Nottoli ..... 273/149

(Continued)

FOREIGN PATENT DOCUMENTS

DE 44 39 502 C1 9/1995

(Continued)

OTHER PUBLICATIONS

U.S. Appl. No. 10/885,875, filed Jul. 7, 2004, Soltys et al.

(Continued)

*Primary Examiner*—Dmitry Suhol
*Assistant Examiner*—Robert Mosser
(74) *Attorney, Agent, or Firm*—Seed IP Law Group PLLC

(57) ABSTRACT

Gaming systems, methods, and devices for determining or verifying the outcome of a card game, for example the card game of Baccarat. The systems, methods, and devices can be used in conjunction with the card game to enhance security by optically imaging the hands of playing cards dealt or by optically reading a set of cards to determine the outcome of each game that can be played from that set of cards. The playing cards each have at least one encoded symbol comprised of machine-readable indicia. The gaming system can include a card shoe-reader alone, a card shoe-reader in combination with at least one card hand-reader, or various other embodiments to include other devices such as a discard reader or a bet recognition device. The optically imaged playing cards can be processed within a computing system to allow the authentication of the playing cards.

31 Claims, 16 Drawing Sheets

U.S. PATENT DOCUMENTS

| | | | | |
|---|---|---|---|---|
| 3,493,728 | A | 2/1970 | Braden, Jr. et al. | |
| 3,561,756 | A | 2/1971 | Barnett | 271/41 |
| 3,667,759 | A | 6/1972 | Barr | 273/152.1 |
| 3,690,670 | A | 9/1972 | Cassady et al. | 273/149 P |
| 3,751,041 | A | 8/1973 | Seifert | 273/149 |
| 3,752,962 | A | 8/1973 | Greskovics | 235/61.11 |
| 3,814,436 | A | 6/1974 | Boren | 273/149 |
| 3,907,282 | A | 9/1975 | Hunter | 271/233 |
| 4,031,376 | A | 6/1977 | Corkin, Jr. | 235/156 |
| 4,244,582 | A | 1/1981 | Raees et al. | 273/293 |
| 4,373,726 | A | 2/1983 | Churchill et al. | 273/138 A |
| 4,377,285 | A | 3/1983 | Kadlic | 273/148 A |
| 4,448,419 | A | 5/1984 | Telnaes | 273/143 |
| 4,531,187 | A | 7/1985 | Uhland | 364/412 |
| 4,534,562 | A | 8/1985 | Cuff et al. | 273/149 |
| 4,636,846 | A | 1/1987 | Villarreal | 358/100 |
| 4,662,637 | A | 5/1987 | Pfeiffer | 273/149 |
| 4,667,959 | A | 5/1987 | Pfeiffer et al. | 273/149 |
| 4,693,480 | A | 9/1987 | Smith | 273/296 |
| 4,725,079 | A | 2/1988 | Koza et al. | 283/73 |
| 4,728,108 | A | 3/1988 | Neuwahl | 273/296 |
| 4,750,743 | A | 6/1988 | Nicoletti | 273/148 |
| 4,817,528 | A | 4/1989 | Baker | 101/395 |
| 4,822,050 | A | 4/1989 | Normand et al. | 273/149 |
| 4,832,341 | A | 5/1989 | Muller et al. | 273/139 |
| 4,885,700 | A | 12/1989 | Kondziolka et al. | 364/519 |
| 4,951,950 | A | 8/1990 | Normand et al. | 273/149 |
| 4,995,615 | A | 2/1991 | Cheng | 273/292 |
| 5,039,102 | A | 8/1991 | Miller | 273/148 R |
| 5,053,612 | A | 10/1991 | Pielemeier et al. | 235/462 |
| 5,067,713 | A | 11/1991 | Soules et al. | 273/149 |
| 5,110,134 | A | 5/1992 | Laughlin et al. | 273/293 |
| 5,157,602 | A | 10/1992 | Fields et al. | 364/412 |
| 5,186,464 | A | 2/1993 | Lamle | 273/149 |
| 5,199,710 | A | 4/1993 | Lamle | 273/149 |
| 5,224,712 | A | 7/1993 | Laughlin et al. | 273/304 |
| 5,259,907 | A | 11/1993 | Soules et al. | 156/277 |
| 5,312,104 | A | 5/1994 | Miller | 273/148 |
| 5,362,053 | A | 11/1994 | Miller | 273/148 R |
| 5,374,061 | A | 12/1994 | Albrecht | 273/149 |
| 5,397,133 | A | 3/1995 | Penzias | 273/439 |
| 5,416,308 | A | 5/1995 | Hood et al. | 235/454 |
| 5,417,431 | A | 5/1995 | Gluck | 273/293 |
| 5,431,399 | A | 7/1995 | Kelley | 273/149 |
| 5,511,784 | A | 4/1996 | Furry et al. | 273/143 |
| 5,518,249 | A | 5/1996 | Sines et al. | 273/304 |
| 5,605,334 | A | 2/1997 | McCrea, Jr. | 273/309 |
| 5,613,680 | A | 3/1997 | Groves et al. | 273/138.2 |
| 5,632,483 | A | 5/1997 | Garczynski et al. | 273/148 R |
| 5,654,050 | A | 8/1997 | Whalen-Shaw | 428/35.7 |
| 5,655,961 | A | 8/1997 | Acres et al. | 463/27 |
| 5,669,816 | A | 9/1997 | Garczynski et al. | 463/12 |
| 5,681,039 | A | 10/1997 | Miller | 273/148 R |
| 5,698,839 | A | 12/1997 | Jagielinski et al. | 235/493 |
| 5,707,287 | A | 1/1998 | McCrea, Jr. | 463/27 |
| 5,711,525 | A | 1/1998 | Breeding | 273/292 |
| 5,722,893 | A | 3/1998 | Hill et al. | 463/47 |
| 5,735,525 | A | 4/1998 | McCrea, Jr. | 273/309 |
| 5,743,527 | A | 4/1998 | Harley | 273/150 |
| 5,766,074 | A | 6/1998 | Cannon et al. | 463/16 |
| 5,770,533 | A | 6/1998 | Franchi | 463/42 |
| 5,772,505 | A | 6/1998 | Garczynski et al. | 463/12 |
| 5,779,545 | A | 7/1998 | Berg et al. | 463/22 |
| 5,779,546 | A | 7/1998 | Meissner et al. | 463/25 |
| 5,788,573 | A | 8/1998 | Baerlocher et al. | 463/16 |
| 5,791,988 | A | 8/1998 | Nomi | 463/11 |
| 5,803,808 | A * | 9/1998 | Strisower | 463/11 |
| 5,803,809 | A | 9/1998 | Yoseloff | 463/13 |
| 5,830,064 | A | 11/1998 | Bradish et al. | 463/22 |
| 5,831,669 | A | 11/1998 | Adrain | 348/143 |
| 5,842,921 | A | 12/1998 | Mindes et al. | 463/16 |
| 5,863,249 | A | 1/1999 | Inoue | 463/20 |
| 5,871,400 | A | 2/1999 | Yfantis | 463/22 |
| 5,895,048 | A | 4/1999 | Smith, Jr. | 273/293 |
| 5,911,626 | A | 6/1999 | McCrea, Jr. | 463/27 |
| 5,919,091 | A | 7/1999 | Bell et al. | 463/25 |
| 5,936,527 | A | 8/1999 | Isaacman et al. | 340/572.1 |
| 5,941,769 | A | 8/1999 | Order | 463/12 |
| 5,945,654 | A | 8/1999 | Huang | 235/449 |
| 5,949,050 | A | 9/1999 | Fosbenner et al. | 235/449 |
| 5,954,654 | A | 9/1999 | Eaton et al. | 600/462 |
| 5,967,893 | A | 10/1999 | Lawrence et al. | 463/10 |
| 5,989,122 | A | 11/1999 | Roblejo | 463/22 |
| 6,010,404 | A | 1/2000 | Walker et al. | 463/21 |
| 6,039,650 | A | 3/2000 | Hill | 463/47 |
| 6,042,150 | A | 3/2000 | Daley | 283/86 |
| 6,062,981 | A | 5/2000 | Luciano, Jr. | 463/26 |
| 6,068,552 | A | 5/2000 | Walker et al. | 463/21 |
| 6,093,103 | A | 7/2000 | McCrea, Jr. | 463/27 |
| 6,117,009 | A | 9/2000 | Yoseloff | 463/20 |
| 6,117,012 | A | 9/2000 | McCrea, Jr. | 463/27 |
| 6,126,166 | A | 10/2000 | Lorson et al. | 273/148 |
| 6,145,838 | A | 11/2000 | White | 273/295 |
| 6,149,154 | A | 11/2000 | Grauzer et al. | 273/149 |
| 6,152,822 | A | 11/2000 | Herbert | 463/22 |
| 6,159,096 | A | 12/2000 | Yoseloff | 463/20 |
| 6,166,763 | A | 12/2000 | Rhodes et al. | 348/143 |
| 6,186,892 | B1 | 2/2001 | Frank et al. | 463/19 |
| 6,193,607 | B1 | 2/2001 | Kay | 463/22 |
| 6,196,547 | B1 | 3/2001 | Pascal et al. | 273/292 |
| 6,217,447 | B1 | 4/2001 | Lofink et al. | 463/12 |
| 6,234,898 | B1 | 5/2001 | Belamant et al. | 463/25 |
| 6,250,632 | B1 | 6/2001 | Albrecht | 273/149 R |
| 6,254,096 | B1 | 7/2001 | Grauzer et al. | 273/149 R |
| 6,254,484 | B1 | 7/2001 | McCrea, Jr. | 463/27 |
| 6,264,109 | B1 | 7/2001 | Chapet et al. | 235/492 |
| 6,267,248 | B1 | 7/2001 | Johnson et al. | 209/547 |
| 6,267,671 | B1 | 7/2001 | Hogan | 463/25 |
| 6,293,864 | B1 | 9/2001 | Romero | 463/12 |
| 6,299,536 | B1 | 10/2001 | Hill | 463/47 |
| 6,312,334 | B1 | 11/2001 | Yoseloff | 463/25 |
| 6,313,871 | B1 | 11/2001 | Schubert | 348/143 |
| 6,315,664 | B1 | 11/2001 | Baerlocher et al. | 463/21 |
| 6,346,044 | B1 | 2/2002 | McCrea, Jr. | 463/27 |
| 6,357,746 | B1 | 3/2002 | Sadowski | 273/148 |
| 6,361,044 | B1 | 3/2002 | Block et al. | 273/149 R |
| 6,371,482 | B1 | 4/2002 | Hall, Jr. | 273/138.1 |
| 6,394,902 | B1 | 5/2002 | Glavich | 463/20 |
| 6,402,142 | B1 | 6/2002 | Warren et al. | 273/149 |
| 6,403,908 | B2 | 6/2002 | Stardust et al. | 209/587 |
| 6,406,369 | B1 | 6/2002 | Baerlocher et al. | 463/20 |
| 6,409,595 | B1 | 6/2002 | Uihlein et al. | 463/29 |
| 6,413,162 | B1 | 7/2002 | Baerlocher et al. | 463/20 |
| 6,425,824 | B1 | 7/2002 | Baerlocher et al. | 463/16 |
| 6,446,864 | B1 | 9/2002 | Kim et al. | 235/382 |
| 6,457,715 | B1 | 10/2002 | Friedman | 273/274 |
| 6,460,848 | B1 | 10/2002 | Soltys et al. | 273/149 |
| 6,464,581 | B1 | 10/2002 | Yoseloff | 463/20 |
| 6,468,156 | B1 | 10/2002 | Hughs-Baird et al. | 463/25 |
| 6,471,208 | B2 | 10/2002 | Yoseloff et al. | 273/143 |
| 6,502,116 | B1 | 12/2002 | Kelly et al. | 708/250 |
| 6,508,709 | B1 | 1/2003 | Karmarkar | 463/42 |
| 6,514,140 | B1 | 2/2003 | Storch | 463/25 |
| 6,517,435 | B2 | 2/2003 | Soltys et al. | 463/25 |
| 6,517,436 | B2 | 2/2003 | Soltys et al. | 463/29 |
| 6,517,437 | B1 | 2/2003 | Wells et al. | 463/30 |
| 6,520,857 | B2 | 2/2003 | Soltys et al. | 463/29 |
| 6,527,271 | B2 | 3/2003 | Soltys et al. | 273/148 |
| 6,530,836 | B2 | 3/2003 | Soltys et al. | 463/29 |
| 6,530,837 | B2 | 3/2003 | Soltys et al. | 463/29 |
| 6,533,276 | B2 | 3/2003 | Soltys et al. | 273/148 |
| 6,533,662 | B2 | 3/2003 | Soltys et al. | 463/25 |
| 6,533,664 | B1 | 3/2003 | Crumby | 463/42 |
| 6,561,897 | B1 | 5/2003 | Bourbour et al. | 463/13 |

| | | | | |
|---|---|---|---|---|
| 6,568,678 | B2 | 5/2003 | Breeding et al. | 273/149 |
| 6,579,180 | B2 | 6/2003 | Soltys et al. | 463/25 |
| 6,579,181 | B2 | 6/2003 | Soltys et al. | 463/25 |
| 6,582,301 | B2 * | 6/2003 | Hill | 463/11 |
| 6,588,750 | B1 | 7/2003 | Grauzer et al. | 273/149 |
| 6,588,751 | B1 | 7/2003 | Grauzer et al. | 273/149 |
| 6,595,857 | B2 | 7/2003 | Soltys et al. | 463/29 |
| 6,599,185 | B1 | 7/2003 | Kaminkow et al. | 463/16 |
| 6,629,889 | B2 | 10/2003 | Mothwurf | 463/25 |
| 6,638,161 | B2 | 10/2003 | Soltys et al. | 463/12 |
| 6,651,981 | B2 | 11/2003 | Grauzer et al. | 273/149 |
| 6,651,982 | B2 | 11/2003 | Grauzer et al. | 273/149 |
| 6,652,379 | B2 | 11/2003 | Soltys et al. | 463/22 |
| 6,655,684 | B2 | 12/2003 | Grauzer et al. | 273/149 |
| 6,663,490 | B2 | 12/2003 | Soltys et al. | 463/25 |
| 6,676,127 | B2 | 1/2004 | Johnson et al. | 273/149 R |
| 6,676,516 | B2 | 1/2004 | Baerlocher et al. | 463/25 |
| 6,685,568 | B2 | 2/2004 | Soltys et al. | 463/47 |
| 6,688,979 | B2 | 2/2004 | Soltys et al. | 463/25 |
| 6,698,759 | B2 | 3/2004 | Webb et al. | 273/292 |
| 6,712,693 | B1 | 3/2004 | Hettinger | 463/20 |
| 6,712,696 | B2 | 3/2004 | Soltys et al. | 463/25 |
| 6,726,099 | B2 | 4/2004 | Becker et al. | 235/380 |
| 6,726,205 | B1 | 4/2004 | Purton | 273/148 R |
| 6,728,740 | B2 | 4/2004 | Kelly et al. | 708/250 |
| 6,729,956 | B2 | 5/2004 | Wolf et al. | 463/25 |
| 6,729,961 | B1 | 5/2004 | Millerschone | 463/30 |
| 6,758,751 | B2 | 7/2004 | Soltys et al. | 463/29 |
| 6,857,961 | B2 | 2/2005 | Soltys et al. | 463/47 |
| 6,889,979 | B2 | 5/2005 | Blaha et al. | 273/149 R |
| 6,955,599 | B2 | 10/2005 | Bourbour et al. | 463/13 |
| 7,005,985 | B1 | 2/2006 | Steeves | 340/572.1 |
| 7,011,309 | B2 | 3/2006 | Soltys et al. | 273/149 R |
| 7,029,009 | B2 | 4/2006 | Grauzer et al. | 273/149 P |
| 7,073,791 | B2 | 7/2006 | Grauzer et al. | 273/149 R |
| 7,077,332 | B2 | 7/2006 | Verschuur et al. | 235/492 |
| 7,137,627 | B2 | 11/2006 | Grauzer et al. | 273/149 R |
| 7,255,344 | B2 | 8/2007 | Grauzer et al. | 273/149 R |
| 7,271,727 | B2 | 9/2007 | Steeves | 340/572.7 |
| 7,322,576 | B2 | 1/2008 | Grauzer et al. | 273/149 R |
| 7,384,044 | B2 | 6/2008 | Grauzer et al. | 273/149 R |
| 7,510,194 | B2 | 3/2009 | Soltys et al. | 273/293 |
| 2002/0063389 | A1 | 5/2002 | Breeding et al. | 273/292 |
| 2002/0147042 | A1 | 10/2002 | Vuong et al. | 463/40 |
| 2002/0163125 | A1 | 11/2002 | Grauzer et al. | 273/149 R |
| 2002/0187821 | A1 | 12/2002 | Soltys et al. | 463/11 |
| 2002/0198052 | A1 | 12/2002 | Soltys et al. | 463/42 |
| 2003/0032474 | A1 | 2/2003 | Kaminkow | 463/25 |
| 2003/0036425 | A1 | 2/2003 | Kaminkow et al. | 463/25 |
| 2003/0054878 | A1 | 3/2003 | Benoy et al. | 463/29 |
| 2003/0064774 | A1 | 4/2003 | Fujimoto et al. | 463/16 |
| 2003/0073498 | A1 | 4/2003 | Grauzer et al. | 463/42 |
| 2003/0083126 | A1 | 5/2003 | Paulsen | 463/25 |
| 2003/0090059 | A1 | 5/2003 | Grauzer et al. | 273/149 R |
| 2003/0104856 | A1 | 6/2003 | Wolf | 463/16 |
| 2003/0173737 | A1 | 9/2003 | Soltys et al. | 273/149 R |
| 2003/0176209 | A1 | 9/2003 | Soltys et al. | 463/13 |
| 2004/0067789 | A1 | 4/2004 | Grauzer et al. | 463/11 |
| 2004/0100026 | A1 | 5/2004 | Haggard | 273/304 |
| 2004/0108255 | A1 | 6/2004 | Johnson | 209/547 |
| 2004/0147327 | A1 | 7/2004 | Soltys et al. | 463/47 |
| 2004/0207156 | A1 | 10/2004 | Soltys et al. | 273/292 |
| 2004/0224777 | A1 | 11/2004 | Smith et al. | 463/47 |
| 2005/0012270 | A1 | 1/2005 | Schubert et al. | 273/149 R |
| 2005/0026680 | A1 | 2/2005 | Gururajan | 463/25 |
| 2005/0026681 | A1 | 2/2005 | Grauzer et al. | 463/29 |
| 2005/0026682 | A1 | 2/2005 | Grauzer et al. | 463/29 |
| 2005/0051955 | A1 | 3/2005 | Schubert et al. | 273/149 R |
| 2005/0051965 | A1 | 3/2005 | Gururajan | 273/292 |
| 2005/0054408 | A1 | 3/2005 | Steil et al. | 463/11 |
| 2005/0062226 | A1 | 3/2005 | Schubert et al. | 273/149 R |
| 2005/0062227 | A1 | 3/2005 | Grauzer et al. | 273/149 R |
| 2005/0073102 | A1 | 4/2005 | Yoseloff et al. | 273/292 |
| 2005/0093230 | A1 | 5/2005 | Grauzer et al. | 273/149 R |
| 2005/0101367 | A1 | 5/2005 | Soltys et al. | 463/12 |
| 2005/0121852 | A1 | 6/2005 | Soltys et al. | 273/149 P |
| 2005/0164761 | A1 | 7/2005 | Tain | 463/13 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0001217 | A1 | 1/2006 | Soltys et al. | 273/292 |
| 2007/0060260 | A1 | 3/2007 | Fleckenstein | 463/16 |
| 2008/0113781 | A1 | 5/2008 | Soltys et al. | 463/28 |
| 2009/0115133 | A1 | 5/2009 | Kelly et al. | 273/274 |
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0118006 | A1 | 5/2009 | Kelly et al. | 463/31 |
| 2009/0170594 | A1 | 7/2009 | Delaney et al. | 463/25 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| EP | 1 291 045 | A1 | 3/2003 |
| FR | 2 775 196 | | 8/1999 |
| GB | 2 246 520 | A | 2/1992 |
| GB | 2 370 791 | A | 7/2002 |
| GB | 2 380 143 | A | 4/2003 |
| WO | WO 96/36253 | | 11/1996 |
| WO | WO 99/43403 | | 9/1999 |
| WO | WO 02/05914 | A1 | 1/2002 |
| WO | WO 02/051512 | A2 | 7/2002 |
| WO | WO 03/004116 | A1 | 1/2003 |
| WO | WO 2006/039308 | A2 | 4/2006 |

OTHER PUBLICATIONS

U.S. Appl. No. 10/902,436, filed Jul. 29, 2004, Soltys et al.
U.S. Appl. No. 10/962,166, filed Oct. 8, 2004, Soltys et al.
U.S. Appl. No. 11/059,743, filed Feb. 16, 2005, Soltys et al.
U.S. Appl. No. 11/112,793, filed Apr. 21, 2005, Soltys et al.
U.S. Appl. No. 11/337,375, filed Jan. 23, 2006, Soltys et al..
U.S. Appl. No. 11/428,240, filed Jun. 30, 2006, Fleckenstein.
U.S. Appl. No. 11/428,244, filed Jun. 30, 2006, Soltys.
U.S. Appl. No. 11/428,249, filed Jun. 30, 2006, Fleckenstein
U.S. Appl. No. 11/428,253, filed Jun. 30, 2006, Fleckenstein
U.S. Appl. No. 11/428,258, filed Jun. 30, 2006, Fleckenstein.
U.S. Appl. No. 11/428,264, filed Jun. 30, 2006, Soltys
U.S. Appl. No. 11/428,286, filed Jun. 30, 2006, Soltys et al..
U.S. Appl. No. 11/437,590, filed May 19, 2006, Soltys et al..
U.S. Appl. No. 11/478,360, filed Jun. 29, 2006, Fleckenstein.
U.S. Appl. No. 11/479,930, filed Jun. 30, 2006, Soltys et al.
U.S. Appl. No. 11/479,963, filed Jun. 29, 2006, Fleckenstein.
U.S. Appl. No. 11/479,991, filed Jun. 29, 2006, Soltys
U.S. Appl. No. 11/480,273, filed Jun. 30, 2006, Soltys.
U.S. Appl. No. 11/480,275, filed Jun. 30, 2006, Fleckenstein
U.S. Appl. No. 11/480,295, filed Jun. 29, 2006, Fleckenstein.
U.S. Appl. No. 11/480,321, filed Jun. 30, 2006, Soltys.
U.S. Appl. No. 11/480,345, filed Jun. 30, 2006, Fleckenstein.
U.S. Appl. No. 11/480,349, filed Jun. 30, 2006, Soltys et al.
U.S. Appl. No. 11/519,244, filed Sep. 11, 2006, Soltys et al.
U.S. Appl. No. 60/838,280, filed Aug. 17, 2006, Soltys et al.
Bulaysky, J., "Tracking the Tables," *Casino Journal*, May 2004, pp. 44-47, accessed December 21, 2005, URL= http://www.ascendgaming.com/cj/vendors_manufacturers_table/Trackin916200411141AM. htm, 5 pages.
Gros, R., "All You Ever Wanted to Know About Table Games," reprinted from *Global Gaming Business*, August 1, 2003, 2 pages.
Pro, L.V., "Book Review—The Card Counter's Guide to Casino Surveillance," *Blackjack Insider Newsletter*, May 2003, #40, accessed August 25, 2006, URL= http:/bjinsider.com/newsletter_40_surveillance.shtml, 5 pages.
Scarne, J., *Scarne's Encyclopedia of Games*, Harper & Row, New York, 1973, p. 153.

Snyder, A., "The High-Tech Eye," excerpt from *Blackjack Forum*, Spring 1997, accessed Dec. 21, 2005, from Casino Software & Services, LLC, URL = http://www.casinosoftware.com/b_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL = http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPBacc—Intelligent Table Tracking/Features," 2 pages, Nov. 2005.
Bally TMS, "MPBacc—Specifications/Specifications," 2 pages, Nov. 2005.
Bravo Gaming Systems, "Casino Table Wager Analysis and Player Tracking System—Table Operations/Unique Features," accessed April 11, 2005, URL = http://www.genesisgaming, 4 pages.
Casino Software & Services, LLC., accessed August 25, 2006, URL = http:/casinosoftware.com/home.html, 6 pages.
International Guild of Hospitality & Restaurant Managers, "Shuffle Master, Inc. (NasdaqNM:SHFL)," accessed Dec. 30, 2003, URL=http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Plaintiffs Declaration of Lawrence Luciano in Opposition to Shuffle Master's Motion for Preliminary Injunction, *Card, LLC* v. *Shuffle Master, Inc.*, D. Nev. (No. Cv-N-03-0244ECR-(RAM)), Nov. 24, 2003.
Shuffle Master, Inc., "Shuffle Master Announces New Products; Intelligent Table System to Be Debuted at G2E," Sep. 10, 2003, 2 pages.
Bulaysky, J., "Tracking the Tables," *Casino Journal*, pp. 44-47, May 2004.
Scarne, J., *Scarne's New Complete Guide to Gambling*, Simon & Schuster, Inc., New York, 1974, p. 358-359.
U.S. Appl. No. 11/558,409, Soltys.
English Translation of German Patent No. DE 197 48 930, publication date of May 14, 1998, inventor: Markeev.
Humble, L., *The World's Greatest Blackjack Book*, Random House, Inc., New York, 1987, p. 182.

* cited by examiner

SYSTEMS, METHODS, AND DEVICES FOR MONITORING CARD GAMES, SUCH AS BACCARAT

This application claims priority to provisional application 60/500,898 filed on Sep. 5, 2003.

BACKGROUND OF THE INVENTION

1. Field of the Invention

The present description generally relates to imaging, tracking, and verifying card sequences during card games, such as Baccarat.

2. Description of the Related Art

Card games are a well-known form of recreational entertainment. Games are typically played with one or more decks of cards, where each deck typically includes 52 cards of four suits (i.e., hearts, diamonds, clubs, and spades), each suit including 14 cards of varying rank (i.e., 2-10, Jack, Queen, King and Ace). Card games may, or may not, include wagering based on the game's outcome.

One popular card game is known as Baccarat, which is derived from European baccarat and chemin de fer. There are three variations of Baccarat, standard or Big-Baccarat, Midi-Baccarat, and Mini-Baccarat. The significant difference between the three versions is that in Big-Baccarat, each of the seated players takes a turn dealing the playing cards, in Midi-Baccarat, each of the gaming participants takes a turn dealing only the Player's hand, and in Mini-Baccarat, none of the seated players touch the playing cards—a designated casino dealer handles the playing cards.

In Baccarat, only two hands are dealt, one hand represents the Banker's hand and the other represents the Player's hand. The participants in the game are the actual individuals seated at the Baccarat table. The casino typically plays the role of the banker. The object of the game is for the participants to bet on which one of the two hands, the Player's hand or the Banker's hand, will come closest to a total of nine points or whether the hands will tie. The value of the hand is determined by the rank of the card. Thus, cards having rank Ace-10 have the value 1-10 respectively. Face cards (i.e., Jack, Queen, King) each have the value 10. A hand that is worth 8 or 9 points is generally referred to as a natural. A hand totaling nine is more specifically referred to as le grand natural, while a hand totaling eight is referred to as le petit natural. If the total of a hand exceeds the value of "ten," the hand is scored by dropping the tens-place integer. For instance, if a hand consists of a five and a King, which totals fifteen, the value of the hand is five after dropping the tens-place integer. In a hand with a Ten and a Queen, which totals twenty, the value of the hand is zero. Suits have no bearing on the game of Baccarat. Each hand consists of at least two cards, but no more than three. The Player's initial hand consists of the first and third cards dealt. The Banker's initial hand consists of the second and fourth cards dealt. A third card for the respective hand may or may not be drawn according to fixed rules shown below.

Rules For The Player's Hand:

| Total of Player's Initial Cards: | Based On The Total of the Player's Initial Cards, The Player Must: |
|---|---|
| 0, 1, 2, 3, 4, or 5 | DRAW a third card |
| 6 or 7 | STAND |
| 8 or 9 | STAND (Natural) |

Rules For The Banker's Hand:

| Total of Banker's Initial Cards: | The Player's Third Card Is: | Based On The Total of the Banker's Initial Cards and the Value of the Player's Third Card, The Banker Must: |
|---|---|---|
| 0, 1, or 2 | 0-9 | DRAW |
| 3 | 0-7 or 9 | DRAW |
| | 8 | STAND |
| 4 | 2-7 | DRAW |
| | 0-1, 8 or 9 | STAND |
| 5 | 4-7 | DRAW |
| | 0-3, 8 or 9 | STAND |
| 6 | 6-7 | DRAW |
| | 0-3, 8 or 9 | STAND |
| 7 | 0-9 | STAND |
| 8-9 | 0-9 | STAND (Natural) |

Card games are particularly popular in casinos and other gaming establishments. Players wager large sums of money while playing card games, thus, it is desirable to ensure that those playing the game are not cheating, for example by substituting one or more cards into the deck or hand, or marking cards. Further, it is desirable to monitor the game in a relatively unobtrusive manner to allow casino customers to feel comfortable in their surroundings.

BRIEF SUMMARY OF THE INVENTION

In one aspect, a method of evaluating card games played with a number of playing cards at a gaming table comprising determining a starting sequence of the playing cards in a set of playing cards from which at least one card game will be dealt; automatically determining an identity of each of a number of playing cards forming a first hand dealt from the set of playing cards; automatically determining an identity of each of a number of playing cards forming a second hand dealt from the set of playing cards; automatically determining whether the identity of each playing card forming the first hand matches an expected identity of playing cards forming the first hand based on the starting sequence before any wagers are resolved; and automatically determining whether the identity of each playing card forming the second hand matches an expected identity of playing cards forming the second hand based on the starting sequence before any wagers are resolved.

In another aspect, a gaming system for managing a card game played with playing cards from a set of playing cards comprising a card shoe from which playing cards may be dealt in a determined order; a first card hand-reader sized to receive a portion of each of at least two playing cards forming a hand of playing cards while the at least two playing cards are positioned such that at least a first human-readable symbol carried on a face of each of the playing cards is viewably exposed to a wagering participant, and to read a machine-readable identifier carried by each of the at least two playing cards while the at least two playing cards are positioned in the first card hand-reader; and a processor communicatively coupled to receive identifying data from the first card hand reader and configured to compare an identity of each of the playing cards in the hand to an expected identity for each card in the hand based on the determined order.

In yet another aspect, a card hand-reader to read identifying data from each of a number of playing cards forming a hand comprising a frame sized to receive a portion of up to three playing cards forming a hand while at least a first human-readable symbol on at least two of the playing cards is exposed to a game participant; and at least one optical sensor providing a field of view encompassing an area sufficient to image a machine-readable symbol bearing portion of the up to three playing cards when the playing cards are received in the frame.

In still yet another aspect, a card identification system for evaluating an outcome of at least one card game, the card game played with a set of encoded playing cards a card shoe-reader sized to receive the set of playing cards; an optical scanner communicatively coupled to the card shoe-reader for reading the set of encoded playing cards to determine a sequence of the set of playing cards; a processor in communication with the card shoe-reader for evaluating the sequence of the set of playing cards based on a known dealing sequence and card game rules, the processor further configured to determine an outcome of each card game that can be played from the set of playing cards; and an indicator in communication with the processor for indicating the outcome of the card game.

In still yet another aspect, a method of determining an outcome of at least one card game, the card game being selectable from a set of playing cards comprising determining a card sequence of the set of playing cards from which the card game will be selected; evaluating the card sequence to determine the outcome of the at least one card game based on a set of card game rules and a dealing sequence, the outcome being determined for the at least one card game at any time before a wager is resolved, but after the card sequence is determined from the set of playing cards; and providing an indication as to which one of the hands selected from the set of playing cards comprises a winning hand or whether the hands are a tie.

In still yet another aspect, a method of determining an outcome of one card game, the card game being selectable from a set of playing cards comprising determining a card sequence of at least four cards, but less than the entire set, within the set of playing cards from which the card game will be played; evaluating the card sequence to determine the outcome of the card game based on a set of card game rules and a dealing sequence; removing at least the four cards, but not more than six cards from a card shoe-reader to assemble a first hand and a second hand, each hand having at least two cards each; and providing an indication as to which one of the hands selected from the set of playing cards comprises a winning hand or whether the hands are a tie.

In yet another aspect, a method of determining an outcome of at least one card game, the card game being selectable from a set of playing cards comprising providing the set of playing cards to a gaming table; dealing a number of cards necessary to comprise at least two complete playing hands for the selected card game based on a set of card game rules; positioning each of the number of cards comprising the respective playing hands into at least one card hand-reader; reading a machine-readable indicia from each of the playing cards positioned within the card hand-reader; evaluating the machine-readable indicia from each of the cards to determine the outcome of the card game based on the set of rules; and verifying that the outcome of the card game as determined by the card hand-reader corresponds to the outcome of the card game upon visually totaling the cards making up the respective playing hands.

In yet another aspect, a means for determining an outcome of at least one card game, the card game being selectable from a set of playing cards comprising a support means for supporting the set of playing cards within a receptacle; a reading means for reading a machine-readable symbol from a portion of at least some of the cards within the set of playing cards; and a processing means for digitally interpreting the machine-readable symbols.

In yet another aspect, a device for successively evaluating more than one wager placed on a gaming table comprising a reflector mechanism rotatably coupled with the device, the reflector mechanism is configured to rotate from at least 0 to 360 degrees; a drive mechanism for rotationally positioning the reflector mechanism; a lens mechanism configured to receive a substantial portion of an image deflected from the reflector mechanism, the image comprised of at least a portion of at least one wagering chip; and a processor for decoding the image received by the lens mechanism.

BRIEF DESCRIPTION OF THE SEVERAL VIEWS OF THE DRAWING(S)

In the drawings, identical reference numbers identify similar elements or acts. The size and relative positions of elements in the drawings are not necessarily drawn to scale. For example, the shapes of various elements are not drawn to scale, and some of these elements are arbitrarily enlarged and positioned to improve drawing legibility. Further, the particular shapes and the elements are not intended to convey any information regarding the actual shape of the particular elements, and have been solely selected for their ease and recognition in the drawings.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with cameras, imagers, scanners, optics, computers, computer networks, data structures, databases, and networks such as the Internet, have not been describe in detail to avoid unnecessarily obscuring the descriptions of the embodiments of the invention.

Unless the context requires otherwise, throughout the specification and claims which follow, the word "comprise" and variations thereof, such as "comprises" and "comprising" are to be construed in an open, inclusive sense, that is as "including but not limited to."

Reference throughout this specification to "one embodiment" or "an embodiment" means that a particular feature, structure or characteristic described in connection with the embodiment is included in at least one embodiment of the present invention. Thus, the appearances of the phrases "in one embodiment" or "in an embodiment" in various places throughout this specification are not necessarily all referring to the same embodiment. Further more, the particular features, structures, or characteristics may be combined in any suitable manner in one or more embodiments.

The headings provided herein are for convenience only and do not interpret the scope or meaning of the claimed invention.

Card Gaming System Having a First Hand and a Second Hand

Figure 1:
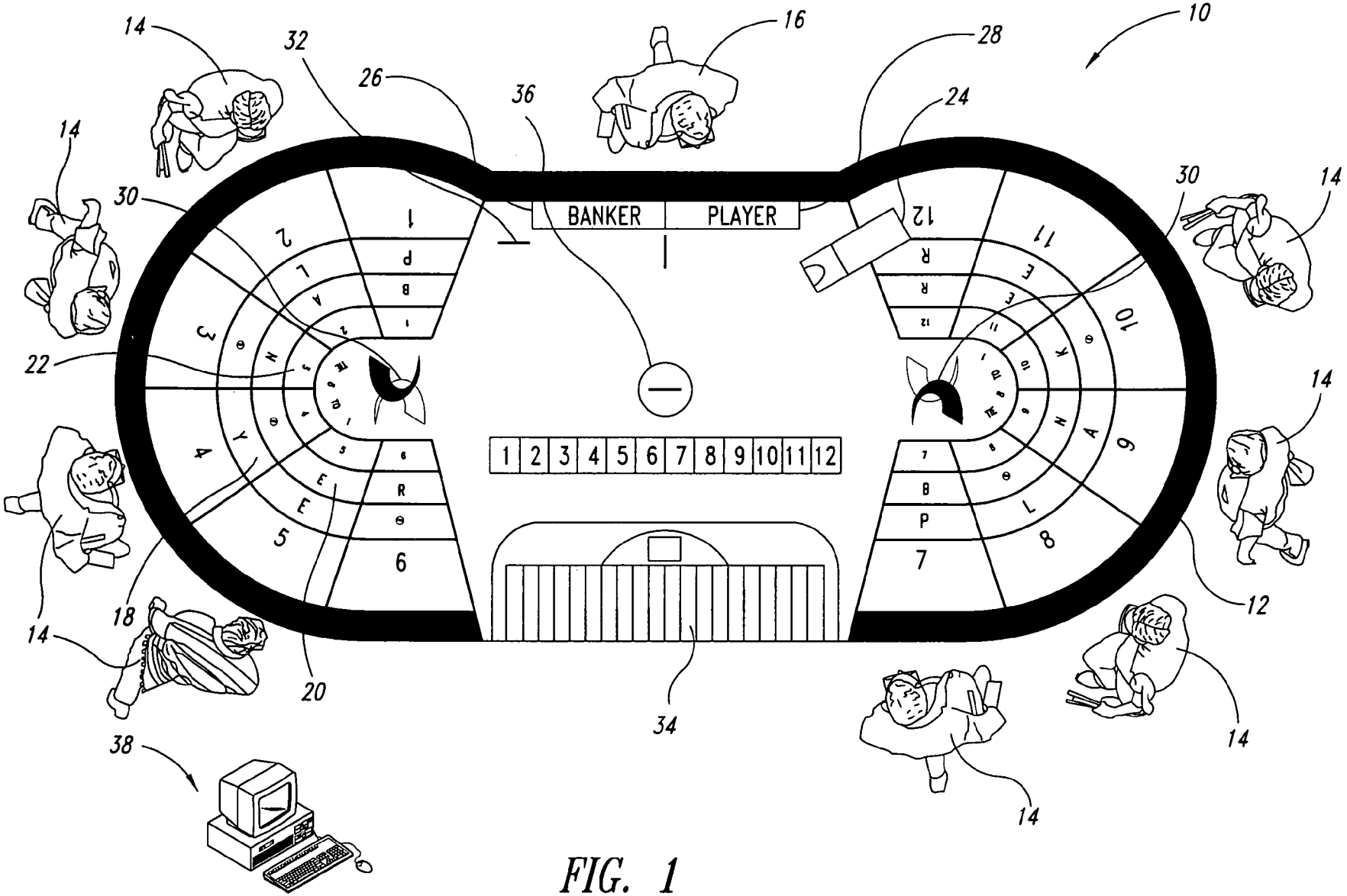
FIG. 1 is a schematic diagram showing an environment in which an embodiment of the invention can operate, including participants at a gaming table with at least a card shoe-reader.

FIG. 1 shows a gaming system 10 including a gaming table 12 at which participants 14 play a card game, for example Baccarat. A dealer 16, also referred to as a caller, can monitor the card game to insure the game runs efficiently. The gaming table 12 may include markings that identify specific regions of the table for placing wagers, for example, the gaming table 12 comprises betting regions for at least three types of wagers, a Player betting region 18, a Banker betting region 20, and a Tie betting region 22. A participant 14 may place wagers by moving one or more gaming chips into one of the betting regions 18, 20, or 22 that aligns with the participant's seating position, illustrated as positions 1-12 on the gaming table 12. One skilled in the art will appreciate that the layout of the gaming table 12 can be patterned or arranged in a variety of ways and the layout shown in FIG. 1 is for illustrative purposes only. In addition, one skilled in the art will appreciate that fewer or larger numbers of participants may be seated at the gaming table 12.

A variety of devices may be used in conjunction with the gaming table 12 to augment the card game. In the illustrated embodiment, a card shoe-reader 24 can be used as a means for selecting the playing cards during the dealing process where the card shoe-reader 24 may hold, for example, up to eight decks of playing cards. The card shoe-reader 24 may also be used for reading respective machine-readable indicia from each of a number of playing cards inserted into the card shoe-reader 24, as described in detail below. Two card hand-readers 26, 28 can be used to read a first hand and second hand, respectively, dealt during the game. A bet recognition device 30 can be used to read and monitor the amount and location of the wagers (i.e., type and quantity of gaming chips constituting a given wager) of each participant 14.

Further, at the conclusion of each hand, the dealer/caller 16 can access a chip tray 34 for processing the wagers made by the participants 14. In typical gaming environments 10, a bank or chip tray 34 on the gaming table 12 provides storage for holding the house's (e.g., casino's) chips (not shown). The chip tray 34 allows the dealer 16 to collect or "hold" losing wagers and pay out winning wagers. Chips in the chip tray 34 are generally arranged in columns and may be organized by denomination. A deposit slot 36 may be used by the dealer 16, or another person having authority in the casino, to deposit any cash or markers received for the purchase of more gaming chips.

A magnetic stripe reader 32 can be used to read a player's comp card. Although not illustrated, a discard reader can be used to read any discarded playing cards, for example burn cards or the cards that comprised the first and second hands during the most recently played card game. It is common practice among casinos to remove several "burn cards" from a new or replacement card shoe-reader 24, prior to a first hand being dealt from that card shoe-reader 24. The number of burn cards selected is typically a matter of individual casino policy and the burn process is usually only done once when the card shoe-reader has a fresh set of playing cards.

The various devices such as the card shoe-reader 24, the card hand-readers 26, 28, the bet recognition device 30, and the magnetic stripe reader 32, can all be in combination with the gaming table 12 and each can be in communication with one another, a computing system 38, or both. In one embodiment, the dealer/caller 16 may interact with the computing system 38 via a user interface. Alternatively, the dealer/caller 16 may not have access to the computing system 38 such that the system may essentially operate behind the scenes to monitor the gaming environment.

Figure 2:
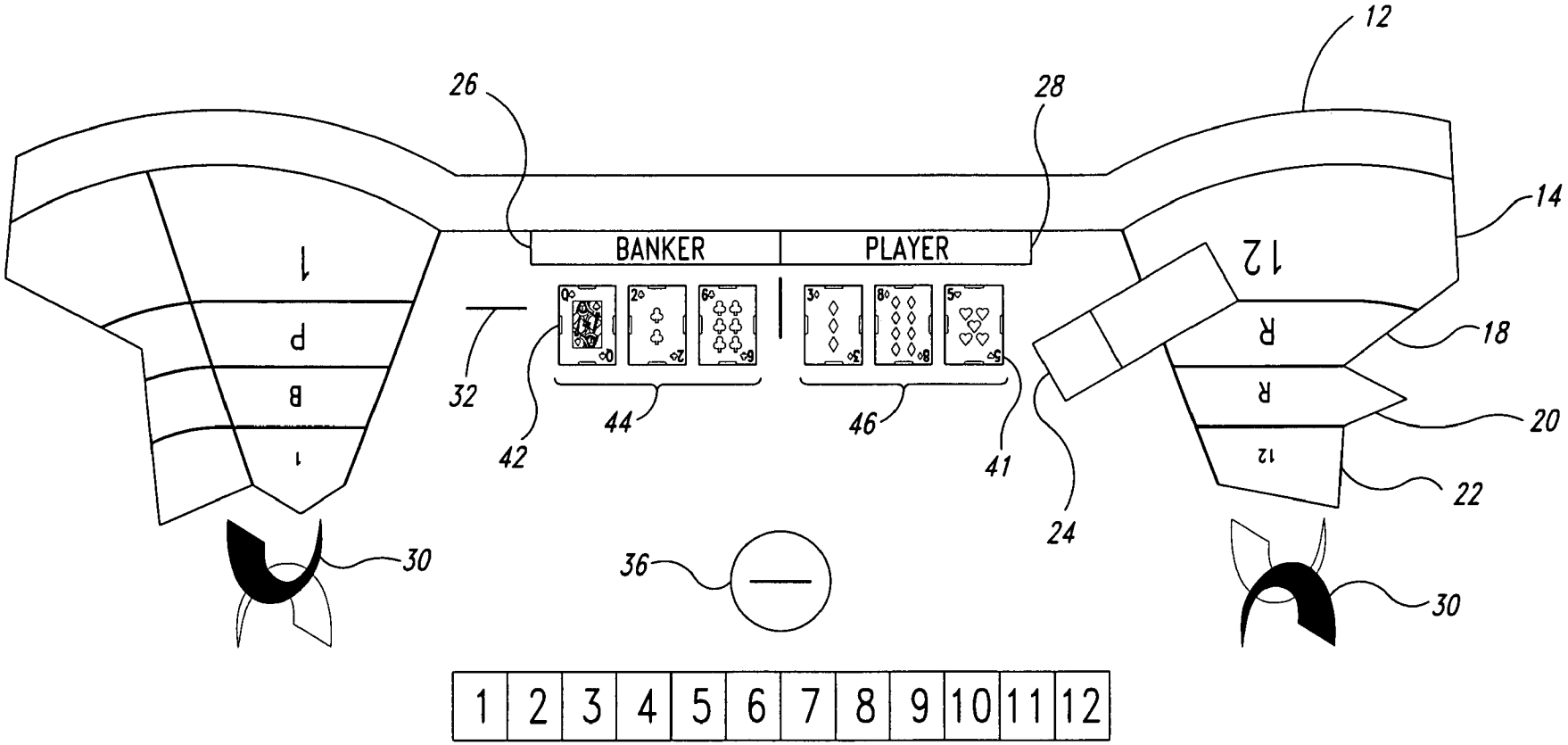
FIG. 2 is a schematic diagram showing a portion of the environment of FIG. 1 in which a first and second hand of playing cards have been distributed.

FIG. 2 shows a close-up view of the portion of the gaming table 12 where the card hand readers 26, 28 may be located. A playing card 41 may be dealt from a set of playing cards 40 (not shown) located within the card shoe-reader 24. The process of dealing can be conducted according to a dealing sequence and a set of rules for the particular card game. After a playing card 41 is removed from the card shoe-reader 24, the playing card can be inserted into at least one card hand-reader 26, 28. The first card hand-reader 26 may be configured to receive at least three playing cards comprising the first hand 44. Likewise, a second card hand-reader 28 may be configured to receive at least three playing cards comprising a second hand 46. The first and second hands, 44, 46 must be comprised of at least two playing cards, but not more than three playing cards. Each individual playing card 41 may have a machine-readable indicia 42 encoded on at least one edge of the playing card. Alternatively, the system 10 may rely on standard playing card markings (e.g., rank and/or suit symbols) and optical character recognition techniques. For purposes of clarity, the first hand 44 and the second hand 46 are shown separated (i.e., not inserted) from the card hand-readers 26, 28.

Figure 3:
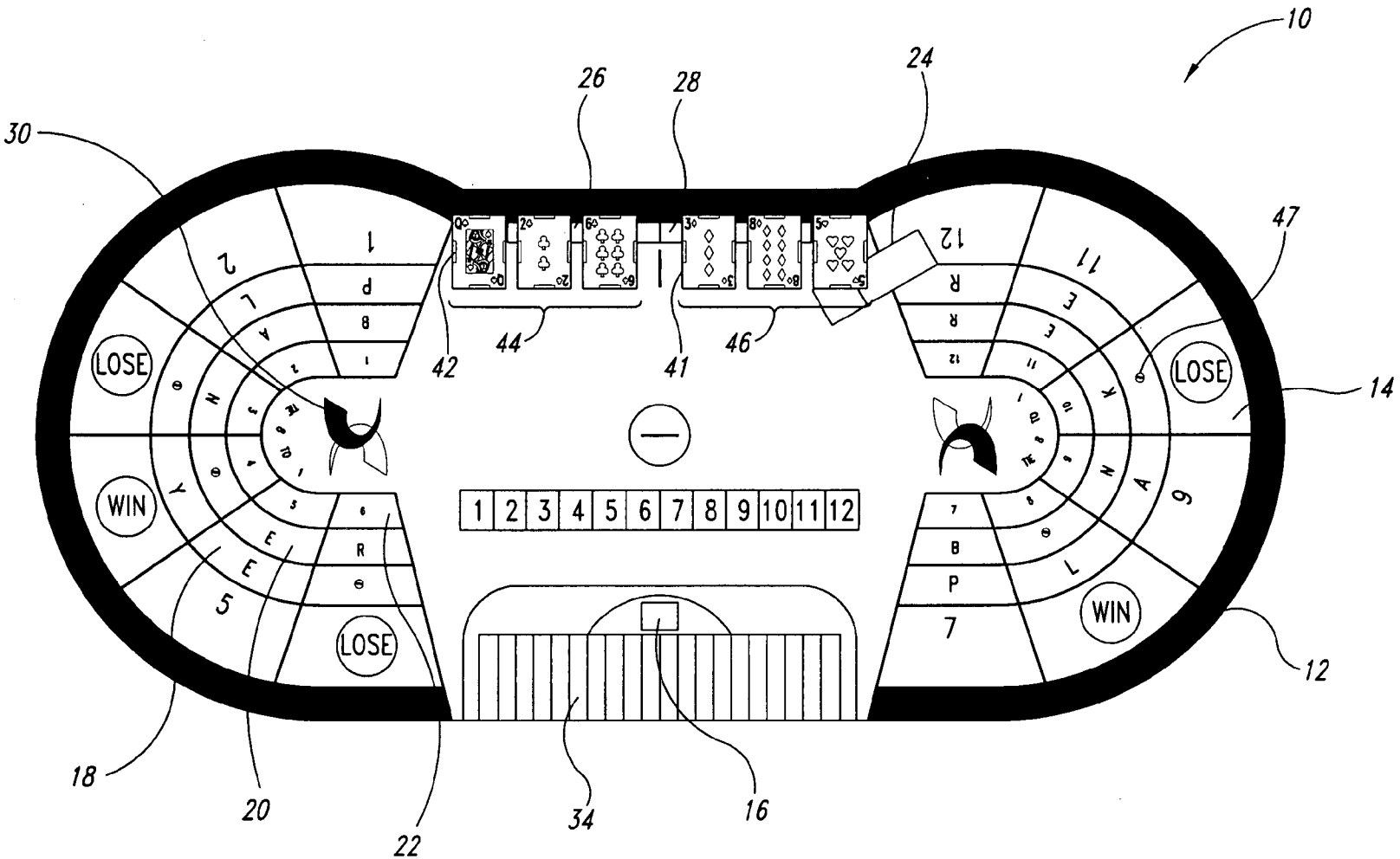
FIG. 3 is a schematic diagram showing a portion of the environment of FIG. 1 in which a winning hand has been determined.

FIG. 3 shows the gaming system 10 at completion of a card after a first hand 44, (e.g., a Banker's hand in the game of Baccarat) and a second hand 46 (e.g., a Player's hand in the game of Baccarat) have been distributed from the card shoe-reader 24. FIG. 3 further indicates that those participants 14, at positions 4 and 8 respectively, who placed a wager 47 on the Banker's hand were successful for that particular round of distributed playing cards.

Playing Cards Encoded with Machine-Readable Indicia

Figure 4:
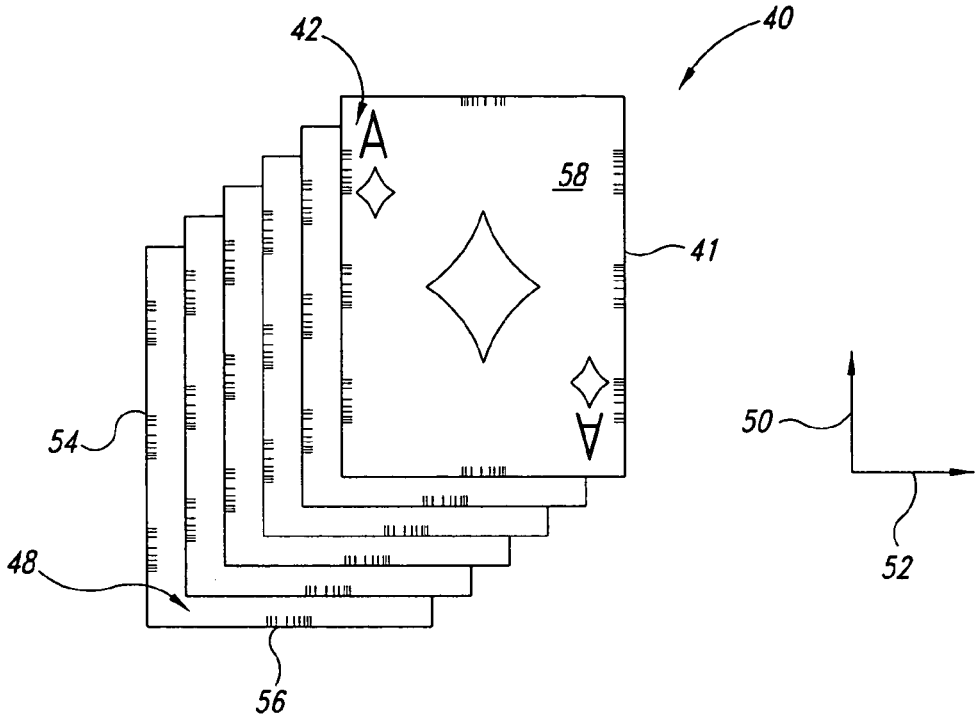
FIG. 4 is a front elevational view of a stacked set of playing cards, each of the playing cards carrying machine-readable indicia on a face of the playing cards.

FIG. 4 shows an exemplary set of playing cards 40 which may be inserted or temporarily stored in the card shoe-reader 24 as a stack. The set of cards 40 may be one or more decks of cards, or may be a lesser or greater number of cards selected from one or more decks of playing cards. (Only six playing cards are illustrated for ease and clarity of presentation.) When placed in the card shoe-reader 24 each of the playing cards 41 are shifted or staggered with respect to adjacent playing cards in the set along at least one of the two perpendicular axes 50, 52, corresponding to a long and short edge 54, 56, respectively, of the playing cards 40. (The amount of shift or stager is exaggerated in FIG. 4 for clarity of presentation. In use, typically less than ⅛ inch of the edges 54, 56 of each playing card 40 will be exposed.). The shift may result from positioning the playing cards 40 on a sloped of inclined surface, as discussed more fully in U.S. patent application Ser. No. 10/017,276, filed Dec. 13, 2001, and entitled "METHOD, APPARATUS AND ARTICLE FOR RANDOM SEQUENCE GENERATION AND PLAYING CARD DISTRIBUTION;" and U.S. patent application Ser. No. 10/360,846, filed Feb. 5, 2003, and entitled "METHOD, APPARATUS AND ARTICLE EMPLOYING MULTIPLE MACHINE-READABLE INDICIA ON PLAYING CARDS."

As further illustrated in FIG. 4, a first information carrying portion bearing a first machine-readable indicia 42 and a second information carrying portion bearing a second machine-readable indicia 48 are exposed (hereinafter the machine-readable indicia will be referenced with numeral 42, regardless of where it is placed on the playing card 41). The exposed portions are preferably proximate the edges 54, 56 of the playing card 41. The exposed portions may be an end portion along an edge of the face 58 (i.e., surface bearing the rank and suit markings) or the back (i.e., surface bearing a uniform marking for each playing card in the set). Placing the machine-readable indicia on the face 58 of the playing card may make it more difficult for unauthorized people to view or gain access to the information encoded in the machine-readable indicia.

The machine-readable indicia 42 can take the form of barcode, area or matrix code, or stack code symbols selected from respective symbologies to encode identifying information such as the rank and suit of the card, a unique serial number, and/or information about the set of cards 40 to which the playing card 41 belongs. For example, as shown in FIG. 4, the playing cards 40 can carry barcode symbols along each of the edges 54, 56 on the faces of the playing cards. Lookup tables or an algorithm can relate a unique serial number encoded in one or both the machine-readable indicia 42 to one another, or to other identifying information, such as the rank, suit, casino, manufacturer of the card and/or card set 40. Use of a proprietary machine-readable symbology can enhance security and efficiency. Encryption can also enhance security, for example, encrypting the unique serial numbers or other information before encoding the information into the machine-readable indicia 42. The machine-readable indicia 42 can also take advantage of error correction, to discover and correct errors. Error correction techniques, for example Reed-Solomon error correction are generally known in the automatic data collection ("ADC") arts. While visibly illustrated in FIG. 4, the machine-readable indicia 42 can be printed using ink that is not typically visible to humans, such as ink that is only visible in the infrared or ultraviolet portions of the electromagnetic spectrum.

The particular embodiment illustrated has a number of reading and securing advantages over other embodiments. Printing the machine-readable indicia 42 in invisible ink makes unauthorized detection and reading of the machine-readable indicia 42 difficult, and also makes the deck marking unobtrusive to participants 14 (FIG. 1). Employing machine-readable indicia 42 on two perpendicular edges 54, 56, allows for redundancy and/or security not otherwise available for playing cards marked with machine-readable indicia. Repeating the machine-readable symbol 42 two or more times along any given edge 54, 56 also provides redundancy helping to ensure that the card is correctly identified within the card shoe-reader 24. Additionally, or alternatively, employing multiple machine-readable indicia 42 per card, may permit a substantially larger amount of information to be stored on any given playing card 41.

Card Shoe-Reader

Figure 5:
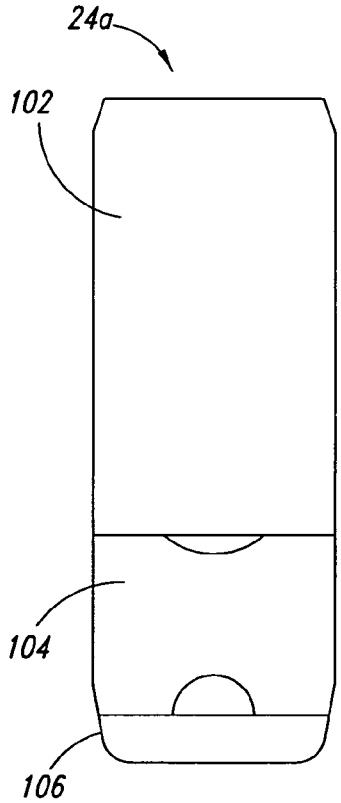
FIG. 5 is a top plan view of an embodiment of a card shoe.

Referring to FIG. 5, and to FIG. 1 as necessary, one embodiment of a standard card shoe **24*a* is illustrated. The illustrated card shoe 24*a* is the type without any optical reading components, thus being different from the card shoe-reader 24*b* discussed previously and in more detail below. The card shoe 24*a* is described herein to identify the components of a standard card shoe 24*a*. The card shoe 24*a* includes a housing 102 having a receptacle sized and dimensioned to receive the set of playing cards 40. The housing 102 may be coupled to a front housing 104, which includes a card access region 106. The card access region 106 can be a sufficiently sloped surface that allows the playing cards 41 to be individually removed from the card shoe 24*a*. The standard card shoe 24*a* may simply be placed on the gaming table 12**.

Figure 6:
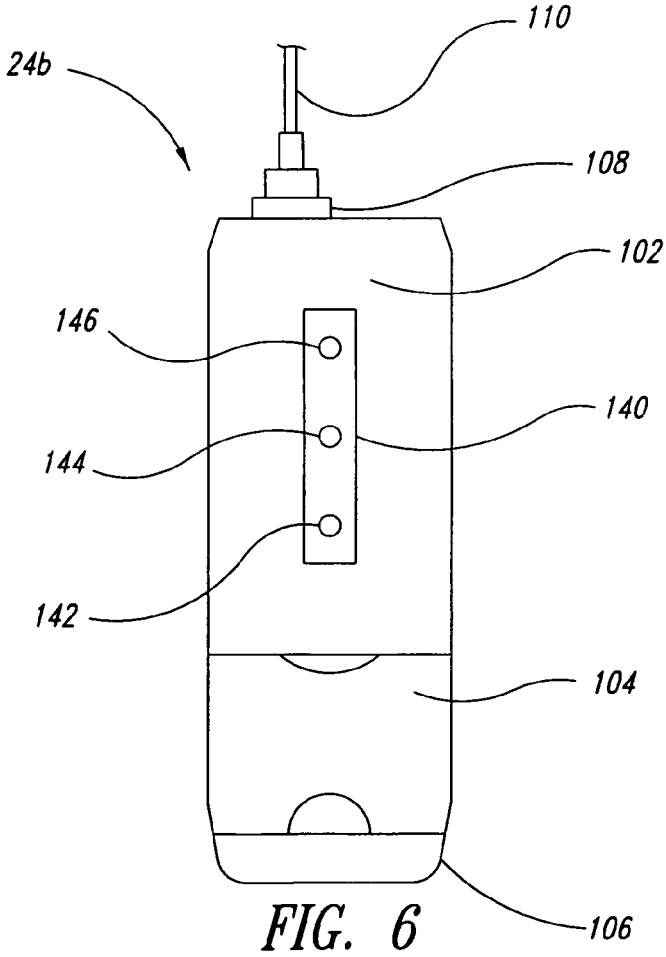
FIG. 6 is a top plan view of a one embodiment of a card shoe-reader with an indicator to announce an outcome of the game.

FIG. 6 illustrates another embodiment of a card shoe-reader **24*b* that may be configured with optical reading components, communication devices for transmitting or receiving data, digital processing equipment, or some combination thereof. The card shoe-reader 24*b* may have the same look and feel and many of the standard components as the card shoe 24*a*, discussed above. Likewise, the card shoe-reader 24*b* may be attachable/detachable, sufficiently affixed to the gaming table 12, or again simply be supported by the gaming table 12. One advantage of the card shoe 24*a* being attachable to the gaming table 12 is to ensure the stability of the card shoe 24*b* during the game in the event the gaming table 12 gets bumped. Another advantage is that the card shoe 24*b* may be detached from the gaming table 12 and taken to a different location, such as a back room of the casino, to be reloaded with a fresh set of cards 40. The practice of reloading card shoes in a back room of the casino is fairly commonplace to avoid causing any distractions in the vicinity of the gaming environment and to not detract from the efficiency of the dealer/caller 16 (FIG. 1). Alternatively, the card shoe 24*a* may be sufficiently affixed to the gaming table 12. In such an alternative embodiment, a new set of cards 40 could be shuffled and reloaded into the card shoe 24***a* at the gaming table 12.

Because the card shoe-reader 24*b* may be configured with the optical reading components, communication devices for transmitting or receiving data, digital processing equipment, or some combination thereof, the physical devices called on to perform those functions may be enclosed within the housing 102 (i.e., making the card shoe-reader 24*b* a self-contained, self sufficient unit) or at least some of those physical devices may be configured with the gaming table 12, thus permitting an interface with the housing 102. The configuration of the physical devices with the gaming table 12 may take the form of these devices being embedded, recessed, attached, or supported by the gaming table 12, for example. An advantage of the card shoe-reader 24*b* is that it can be configured to read all of the playing cards 40 located therein as discussed in more detail below. As such, a starting sequence or dealing sequence of the set of playing cards 40 can be determined, but not necessarily disclosed, before the first card 41 is dealt from the card shoe-reader 24*b*. Since the rules of Baccarat dictate the play of the game, the outcome of each hand may be determined from the starting sequence before a first card 41 is dealt from the card shoe-reader 24*b*, before a fourth card is dealt from the card shoe-reader 24*b*, or even before a last card is dealt from the card shoe-reader 24*b*. While the outcome of all games played from the set of cards 40 in the card shoe-reader 24*b* may be determined before a first card 41 is dealt, the system may determine the outcome of individual games or consecutive hands 44, 46 before a first card 41 for that particular game or hand 44, 46 is dealt or even before a final card in each game or hand is dealt.

Still referring to FIG. 6, an indicator 140 may be attachable to the card shoe-reader 24*b*. Alternatively, the indicator 140 may be remotely located from the card shoe-reader 24, yet viewable by the participants 14 (FIG. 1) at the gaming table 12. The indicator 140, if remotely located, may be in communication with the card shoe-reader 24*b*, the optical reading components, communication devices for transmitting or receiving data, digital processing equipment, or some combination thereof. Thus, the indicator 140, if used for the game of Baccarat for example, may include three illumination sources 142, 144, and 146. The appropriate illumination source 142, 144, and 146 (e.g., incandescent, LED, LCD, etc.) may be activated after a complete game is dealt including the Banker's hand 44 and the Player's hand 46, but before wagers made by the participants 14 (FIG. 1) are resolved. Since there are only three possible outcomes to the game of Baccarat, a first illumination source 142 can indicate, for example, that the Banker's hand 44 wins. A second illumination source 144 can indicate, for example, that the Player's hand 44 wins. Finally, a third illumination source 146 can indicate, for example, that the Banker's hand 44 ties with the Player's hand 46. The light sources 142, 144, and 146 can each be a discreet, recognizable color or appropriately labeled.

In an alternative embodiment, the indicator 140 may be much more elaborate. For example, the indicator 140 may be a monitor (not shown) remotely connected to the card shoe-reader 24*b*. The monitor may be in communication with the processor (not shown) to receive data about the playing cards 40 distributed during a particular game. For example, the monitor can be configured to produce visual representations of the cards as read within the card shoe-reader 24*b*. Of course, if the visual representations did not match the actual cards on the gaming table 12 (FIG. 1), then there would be a discrepancy. The monitor may also "flash," simply indicate Banker, Player, or Tie, or distinguish the winning outcome in some other manner. One advantage of using a visual approach, such as using a monitor, permits the participants 14 (FIG. 1) to play a more interactive role by actually doing the quick comparative check themselves.

As will be discussed in with respect to other embodiments, a reader in the card shoe-reader 24*b* can read (i.e., scan, image, or otherwise sense) the cards 40, typically 2-8 decks, to obtain a starting sequence. One skilled in the art will appreciate that the card shoe-reader 24*b*, and any of the card shoe-readers discussed herein, may be sized and configured to accept substantially more or less than 2-8 decks of cards.

The transmission of data from the card shoe-reader 24*b* to a processing system may be accomplished through a wireless connection (e.g., RF or IR), a wired connection (e.g., a detachable cable), or other communication means 110. Data indicative of the starting sequence can be transmitted through a data port 110 to an appropriate processing device or system (e.g., computing system 38 from FIG. 1). The data port 110 may be coupled and decoupled from the main body of the card shoe-reader 24 with a connector 108. The connector 108 may take the form of any number of standard input/output (I/O) connectors that are used to transmit digital or electronic data.

Figure 7:
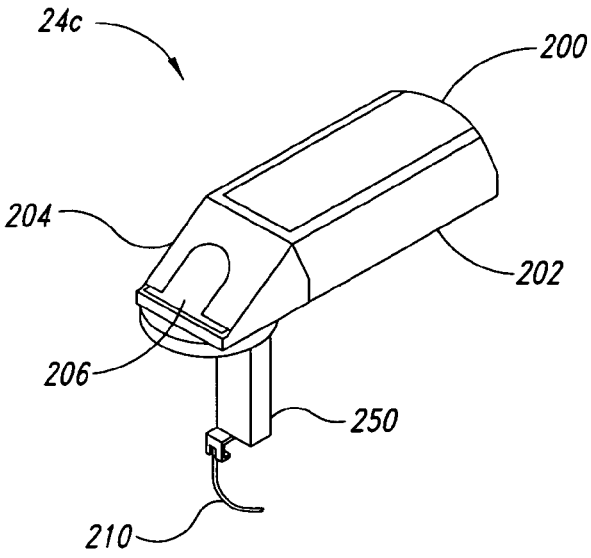
FIG. 7 is a top front isometric view of another embodiment of a card-shoe reader, which can read a set of playing cards.
Figure 8:
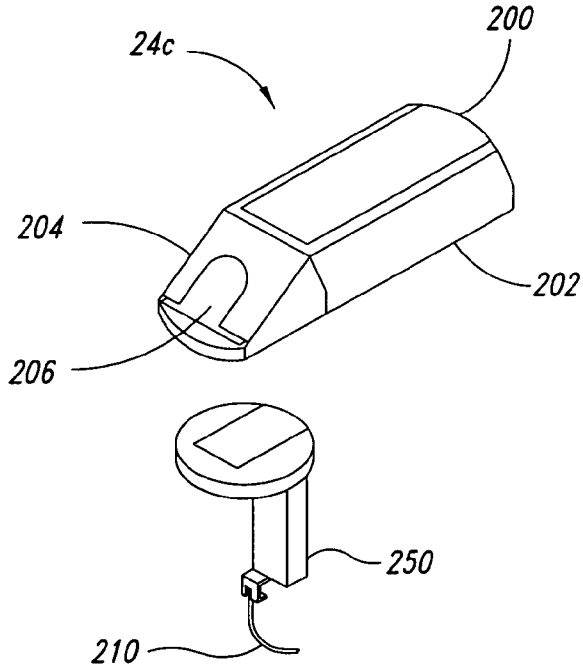
FIG. 8 is an exploded top front isometric view of the card-shoe reader of FIG. 7.
Figure 9:
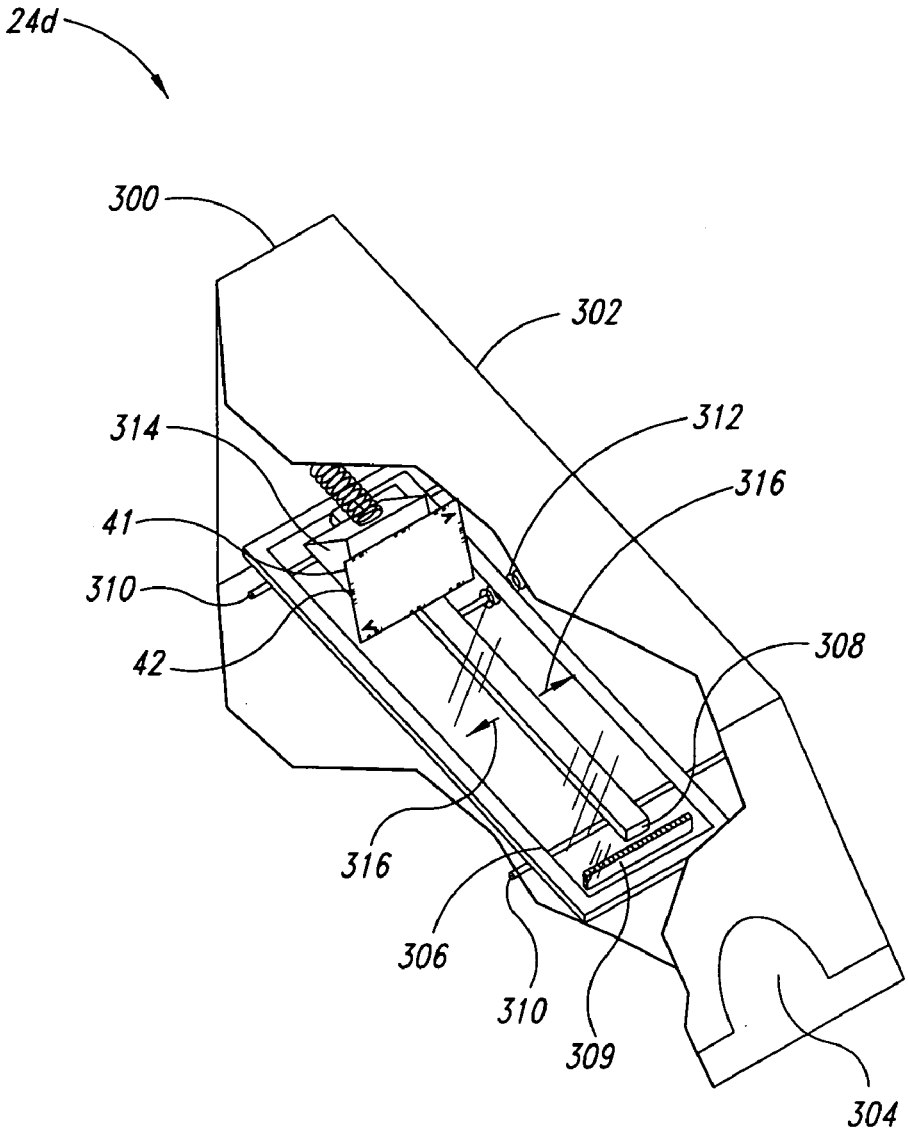
FIG. 9 is a cutaway view of another embodiment of a card-shoe reader having a linear card-reading device integrated with the card shoe body.

FIGS. 7-9 illustrate another embodiment of a card shoe-reader 24*c*. In the illustrated embodiment two primary components are depicted, a main body assembly 200 and that may be detachably coupled to a docking assembly 250. The main body assemble 200 may be comprised of a housing 202, a front housing 204, and a card access region 206, consistent with the previously discussed card shoe-reader embodiments. The one modification that may be required is that the main body assembly may have a support surface (not shown) to support the set of cards 40 within the main body assembly. The support surface, or at least a portion of the support surface, may be sufficiently transparent, clear, or capable of permitting the set of cards 40 to be read by a reader located in the docking assembly 250.

In this particular embodiment, the docking assembly 250 may include the majority, if not all, of the optical and/or electronic imaging or scanning components. FIG. 8, in particular, illustrates that the main body assembly 200 may be detachable from the docking assembly 250. As noted previously, the docking assembly 250 may be configured or integrated with the gaming table such that it is substantially affixed to the gaming table 12 (FIG. 1). Although no connection is truly permanent, the connection of the docking assembly 250 with the gaming table 12 can be sufficient to protect the expensive optical and/or other electrical components from being stolen, accessed, or tampered with and further protects these components from being unintentionally damaged, for example, if a casino employee accidentally dropped the main body assembly 200 of the card shoe-reader 24*c* en route to a gaming table 12. Thus, the main body assembly 200 of the card shoe-reader 24*c* primarily functions as only a receptacle for the set of playing cards 40. Likewise, the docking assembly 250 may either contain circuitry for processing the scanned or imaged data or be configured to transmit such data to a remotely located processor (not shown).

The reader that may be employed with the illustrated embodiment may be a card-reading device (not shown) capable of reading at least a portion of the set of cards 40. For example, the card-reading device may take the form of optical imagers to capture optical images of the machine-readable symbols 42 portions of the playing cards 41 which are exposed when the set of playing cards 40 is positioned in the main body assembly 200 of the card shoe-reader 24*c*. For example, the card-reading device can take the form of one-dimensional or two-dimensional arrays of charge coupled devices ("CCD"), similar to the ones discussed infra for card hand-readers or bet recognition devices, and suitable optics, such as optical lenses for focusing an image on the CCD array. Such CCD arrays can capture whole images at a time, or can be electronically caused to successively sample (e.g., pixel-by-pixel, row-by-row, or column-by-column) the exposed information bearing portions of the set of playing cards 40 (i.e., electronically scan). Alternatively, the card-reading device can take the form of a CMOS imager capable of capturing one-dimensional or two-dimensional arrays similar to that of a CCD reader. The card-reading devices 308 discussed herein may rely on ambient light, or may include one or more light sources such as light emitting diodes ("LEDs") or incandescent lights (not shown), which may or may not be controlled via the device 308. The structure and operation of the readers 308 discussed herein are more fully described in U.S. patent application Ser. No. 09/790,480, filed Feb. 21, 2001, and entitled "METHOD, APPARATUS AND ARTICLE FOR EVALUATING CARD GAMES, SUCH AS BLACKJACK."

FIG. 9 illustrates another embodiment of a card shoe-reader 24*d* having a main body assembly 300 that incorporates the optical, communication, transmission, processing, or other equipment or some combination thereof with the receptacle for housing the set of cards 40. The cutaway view of the present embodiment of the card shoe-reader 24*d*, for clarity illustration, depicts only one playing card 41 having an encoded symbol 42. It should be understood that typically 8 decks of cards may be loaded within the main body assembly 300. A smooth support surface 306 supports the playing cards 40 and may be sufficiently sloped so that an edge portion of each card, containing at least one of the machine-readable symbols 42, is exposed to a card reading device 308. The layback angle of the cards, which is the angle of the cards relative to the supporting surface 306, must be sufficiently inclined in order to adequately expose the machine-readable symbols 42 on each card 41.

The card-reading device 308 can be positioned beneath the support surface 306. In order for the card-reading device 308 to adequately read the machine-readable symbols 42 on each of the respective cards, a substantial portion of the support surface 306 may be transparent, clear, or sufficiently configured to permit the cards to be read by the card reading device 308. These clear portion of the support surface 306 can take the form of glass, clear plastic, or may include coverings that are transparent in the appropriate portion of the electromagnetic spectrum (e.g., white, infrared, or ultraviolet light) based on the visibility of the particular machine-readable indicia 42.

The card-reading device 308 may take the form of optical scanners to electronically capture the information bearing portions of the playing cards 41 which are exposed when the set of playing cards 40 is positioned in the main body assembly 300. For example, the card-reading device 308 can take the form of one or more laser scanners and appropriate light detector(s). The laser scanners can employ, for example, laser diodes for producing a scanning beam and one or more photodiode detectors for detecting laser light reflected from the machine-readable indicia 42 carried by each of the playing cards 41. In the illustrated embodiment, the card-reading device 308 takes the form of a linear scanner which moves in a scan direction 316. Alternatively, the linear scanner 308 may be configured to translate in a direction that is substantially orthogonal to the illustrated scan direction 316. In such an embodiment, the number of discreet sensors (e.g., charge coupled devices) needed would be commensurate with the number, length, and density of the machine-readable symbols 42 on the playing cards 41.

A casino employee (not shown) or the dealer/caller 16 (FIG. 1) may manually actuate the linear scanner 308 by manipulating a trigger or lever (not shown) that positions the linear scanner 308 into a starting position. When the trigger is released, an actuator 312 provides the necessary force, such as from a spring or other biasing member, to propel the linear scanner 308 beneath the set of cards 40. In another alternative, after the linear scanner 308 is in its starting position, the actuator 312 may be triggered electronically by standard push-button, solenoid means. As one skilled in the art will appreciate, the card reading device 308 may employ alternative means for moving the linear scanner 308, for example, a hydraulic piston arrangement, or some other actuation device capable of propelling the linear scanner 308. In addition, the actuator 312 may be mechanically or electrically triggered to scan the set of cards 40.

To ensure a substantially accurate read the machine-readable symbols 42 from each of the cards in the set of cards 40, it may be desirable to have the actuator 312 propel the linear scanner 308 at a substantially constant velocity. In such an embodiment, the linear scanner 308 would have to be configured to reach the substantially constant velocity before reading a first machine-readable symbol 42. Alternatively, an encoder 309 with graduated markings may be utilized in conjunction with the card-reading device 308. Encoders are well known in the art as being used with optical scanning devices to enhance the likelihood of getting a positive read of a machine-readable symbol, for example a bar code.

Figure 10:
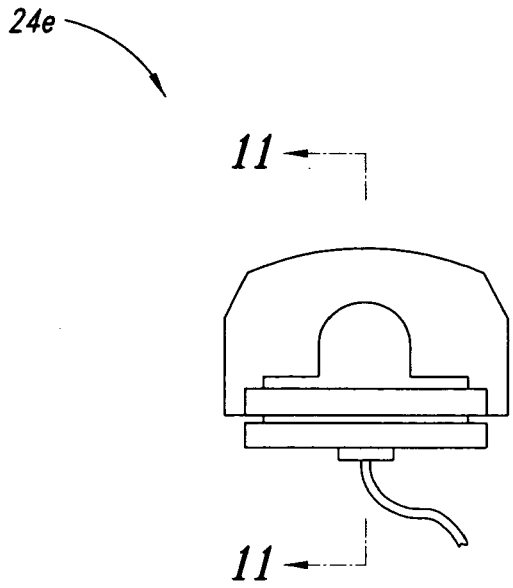
FIG. 10 is a front elevational view of another embodiment of a card shoe-reader having a linear card-reading device with a detachable docking assembly.
Figure 11:
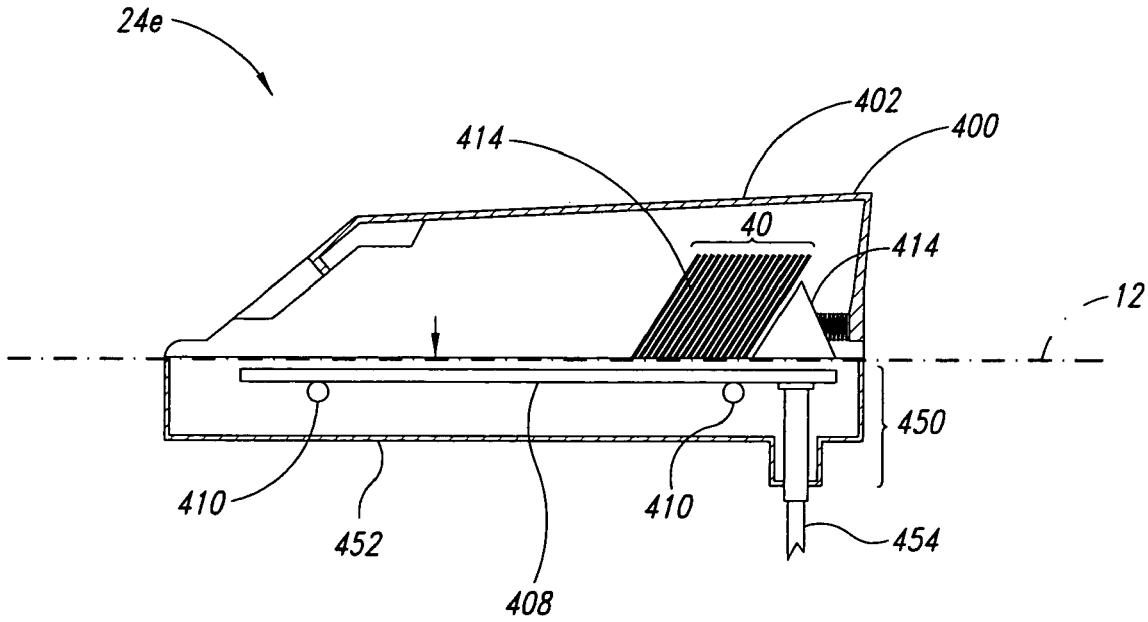
FIG. 11 is a cross-sectional view of the card-shoe reader of FIG. 10.

FIGS. 10-11 illustrate another embodiment of a card shoe-reader 24*e*. This particular embodiment is substantially the same as the previous embodiment with the difference being that the main body assembly 400 is separable or detachable from the docking assembly 450. The illustrated docking assembly 450 may be recessed into the gaming table 12 or otherwise attached thereto. The docking assembly 450 may be configured to complementarily receive the main body assembly 400 of the card shoe-reader 24*e*. An external housing 452 may enclose and support at least one guide 410. The guide or guides can be a set of tracks, rails or other suitable sliding or rolling mechanism. The guides permit the card-reading device 408, which may be structurally and operationally similar to the linear scanner described in the previous embodiment, to traverse in a given scan direction. A data cable 454, or other similar data transfer medium, may be coupled to the card-reading device 408 and routed out of the housing 452 to a processor (not shown). Alternatively, the processor may be contained within the housing 452.

Data ports 454 associated with the card shoe-reader 24*e* couple the imaging or scanning data from the card-reading device 408 to appropriate processing circuitry. As is typical in the automatic data collection (ADC) arts, processing may include amplifying the signal from the detector, analog-to-digital conversion or "wave-shaping" of the amplified signal, and decoding the converted signal into characters represented by the symbols forming the machine-readable indicia 42. Thus, processing typically includes converting an analog signal representing variations in reflectance into digital data, and interpreting the digital data as meaningful information based on the underlying symbology (i.e., a mapping of machine-readable indicia, typically defined in terms of patterns of reflectance, to human-understandable characters).

Card shoe-readers, for example readers 24*b* through 24*e*, add a higher degree of security preventing card tampering for card games, such as Baccarat, where the participants 14 (FIG.

1) are permitted to deal the first hand 44 and the second hand 46. The card shoe-readers promote game security by ensuring complete card accountability and that the cards are dealt in the proper sequence from the shuffled and loaded card shoe-reader 24*b* through 24*e*. In particular, the ability for the card shoe-readers 24*b*, 24*c*, or 24*e*, for instance, to be detached from the docking assembly, which contains the imaging or scanning components, adds an additional level of security and protection by protecting these types of optical or electrical components from being damaged or tampered with. In addition, with respect to the self-contained type card shoe-reader 24*d*, if the set of cards 40 were to be read immediately after an employee loaded the reader, for example in the back room of the casino, this initial read would ensure that no cards were added or removed while the reader was transported from the loading room to the gaming table 12.

Card Hand-Readers

Figure 12:
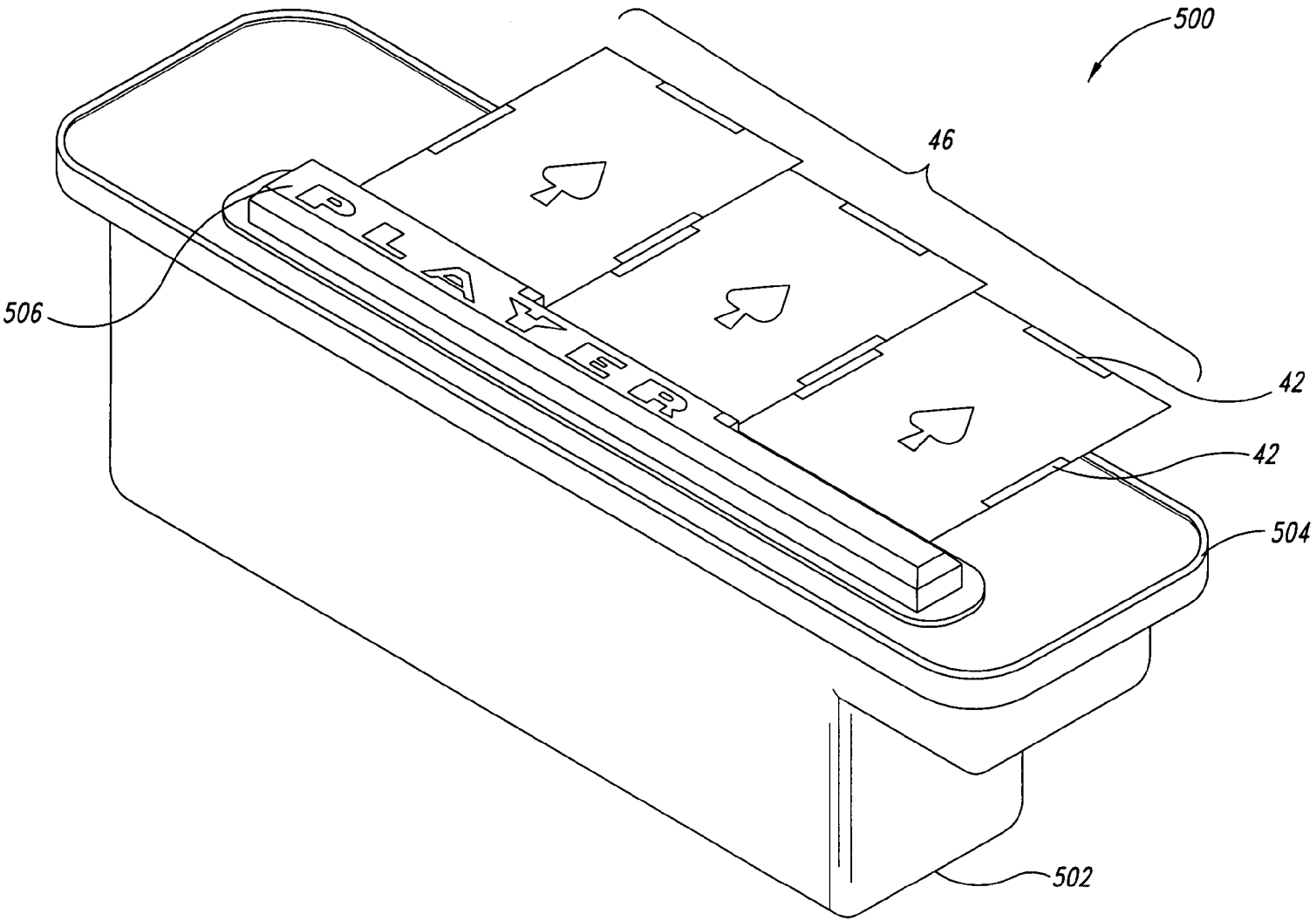
FIG. 12 is a top rear isometric view of a card hand-reader schematically illustrating one hand of playing cards positioned therein.
Figure 13:
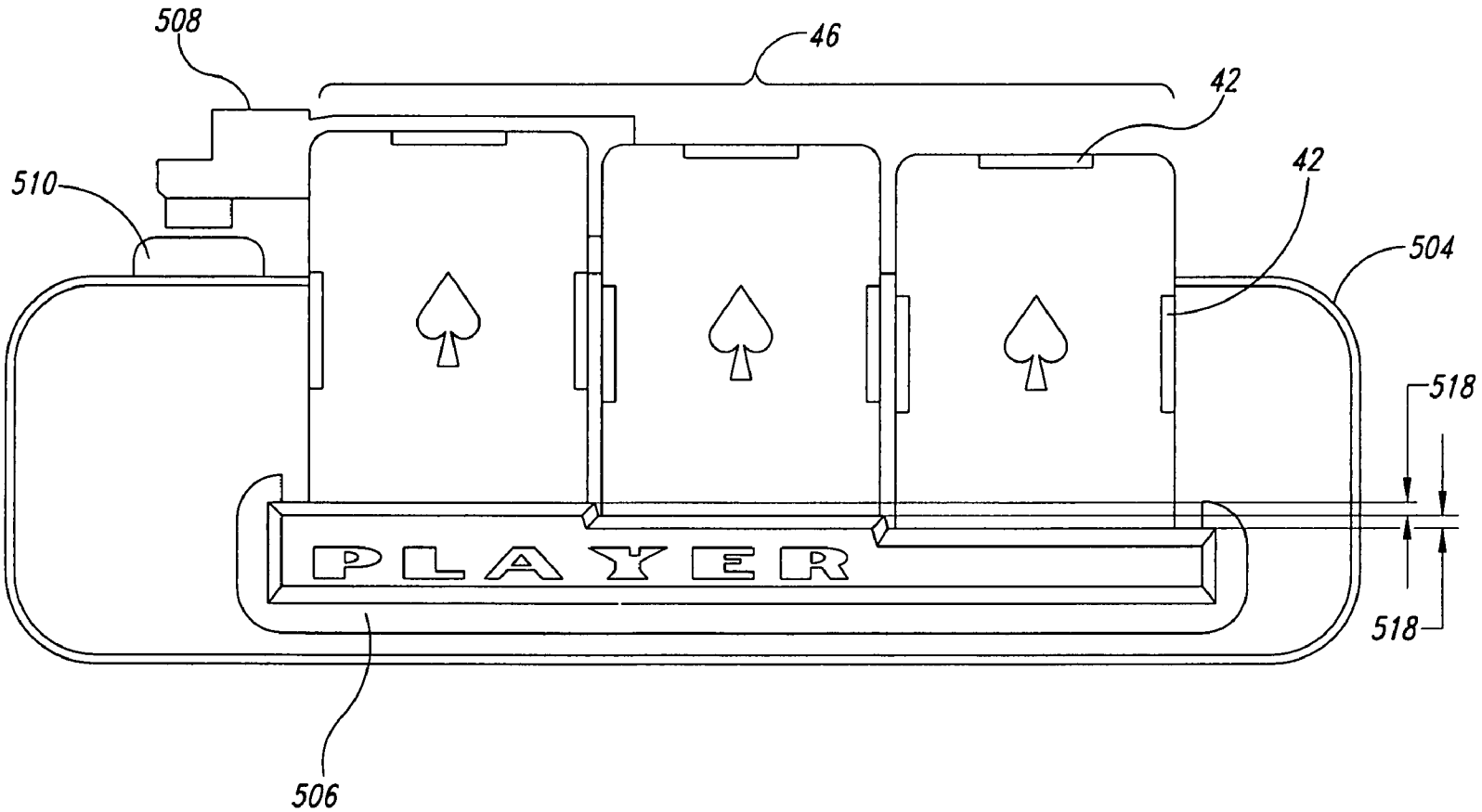
FIG. 13 is a top plan view of the card hand-reader of FIG. 12.
Figure 14:
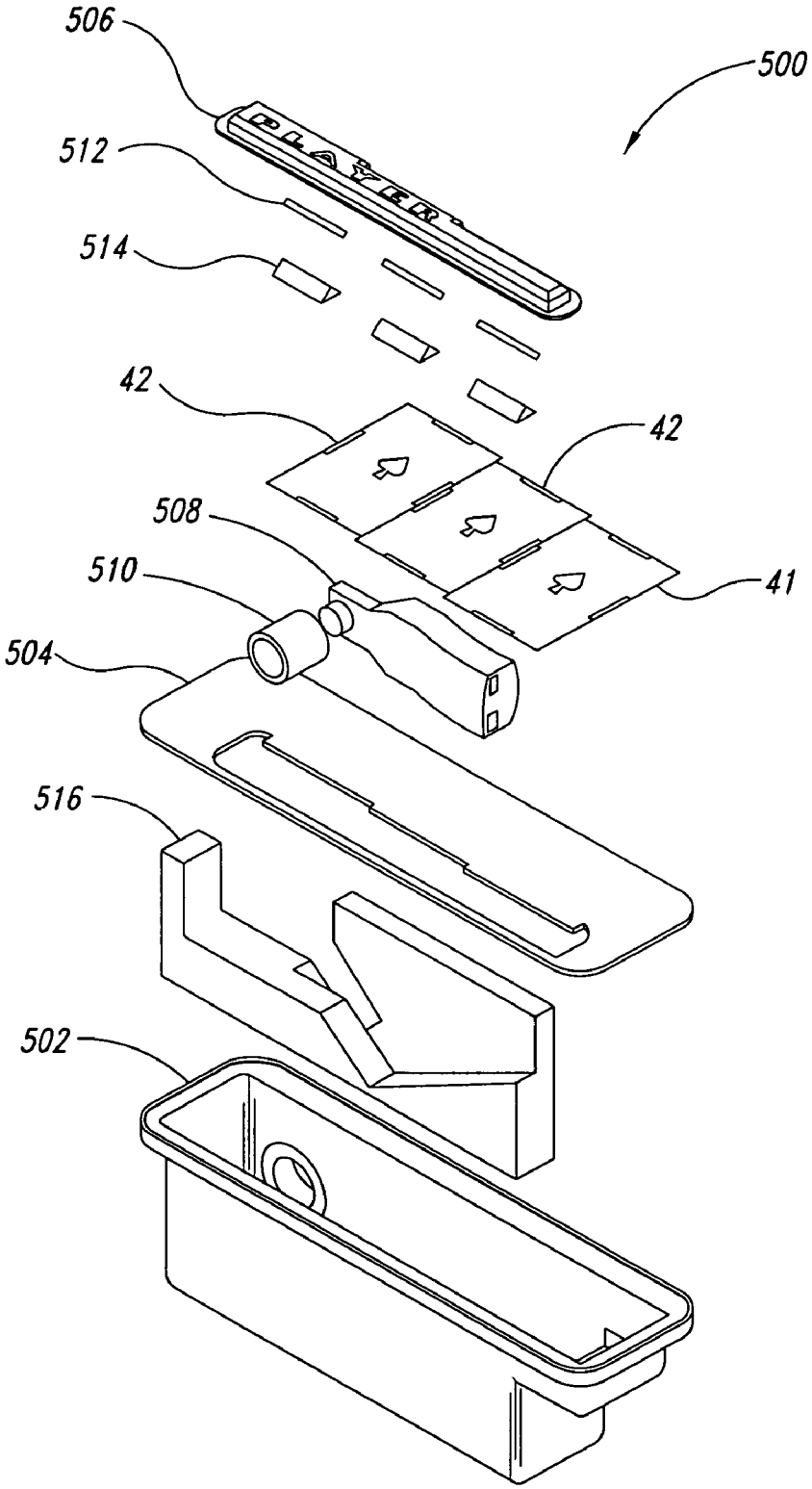
FIG. 14 is an exploded view of the card hand-reader of FIG. 12.

FIGS. 12-14 show a card hand-reader 500 for reading (imaging or scanning) a hand 42 of playing cards according to one illustrated embodiment. The card hand-reader 300 shown in FIG. 12 may read the hand 42, process the acquired data, and compare this data with the known of sequence of cards as determined from reading the cards within the card shoe-reader 24*b-e*. In essence, the card hand-reader 500 operates to verify the card sequence and game outcome that has already been determined by the card shoe-reader 24*b-e*. In the alternative, the card hand-reader 500 may be used in conjunction with a card shoe 24*a* (i.e., the card shoe-reader described above, which is incapable of reading the cards contained therein). The card hand-reader 500, in this instance, verifies that the cards inserted therein are "valid" and "legitimate" playing cards 41 and that the winning hand called out by the dealer/caller 16 is actually the correct winning hand (in the event of an intentional or unintentional error, such as an arithmetic error). In either situation, the structure of the card hand-reader 500 may be used.

Still referring to FIG. 12, the card hand-reader 500 may be used in a game such as Baccarat where the cards making up the hand 42 are typically displayed to all participants 14 (FIG. 1) after the cards are removed from the card shoe-reader 24*b-e*. The card hand-reader 500 may have a lower housing 502, which can contain the majority of the optical imaging components (not shown). Similar to the docking assembly of the detachable card shoe-readers discussed above, the lower housing 502 may be recessed into the gaming table 12. For example, the card hand-reader 500 may include a support member 504, attachable to the lower housing 502, for contiguously contacting a portion of the gaming table 12.

FIG. 13 illustrates a plan view of the card hand-reader 500 of FIG. 12. A reader 508, such as a video or still camera or other optical sensor, with an image sensor 510 may be coupled to the lower housing 502 (FIG. 12). The reader 508 may be used to read each of the cards 41 that comprise the Player's hand 46, for example. The reader 508 may take the form of CMOS or CCD sensors, such as the type taught in U.S. patent application Ser. No. 09/849,456, filed May 4, 2001, and entitled "METHOD, APPARATUS AND ARTICLE FOR VERIFYING CARD GAMES, SUCH AS BLACKJACK." An identifier 506, for naming the particular hand, may be attached to the card hand-reader 500 to assist the gaming participants. As will be further explained below, positioning the cards 41 within the card hand-reader 500 in a staggered configuration 518 is not required, but may be done to facilitate the transmission of the image representing the machine-readable indicia 42. Alternatively, the cards may be positioned in the card hand-reader 500 without being staggered, for example the top edges of the cards may be substantially flush with respect to a single horizontal plane.

FIG. 14 illustrates an exploded view of the card hand-reader 500. As briefly discussed, the reader 508 may read the machine-readable indicia 42. A prism assembly 514 in conjunction with a reflector/mirror assembly 516 may be used to direct an optical image of the machine-readable indicia 42 to the image sensor 510. Although ambient lighting may be sufficient for the reader 508 to pick up a discernible image, an illumination source 512 may be used to direct light onto the applicable portions of the playing cards 41. For example, in the configuration shown in FIG. 14, the illumination source 512 can direct light onto the edge 56 (FIG. 4) of the respective cards 41. Alternatively, the reader 508 may be a linear scanner similar to the one discussed above in the context of a card shoe-reader.

Figure 15:
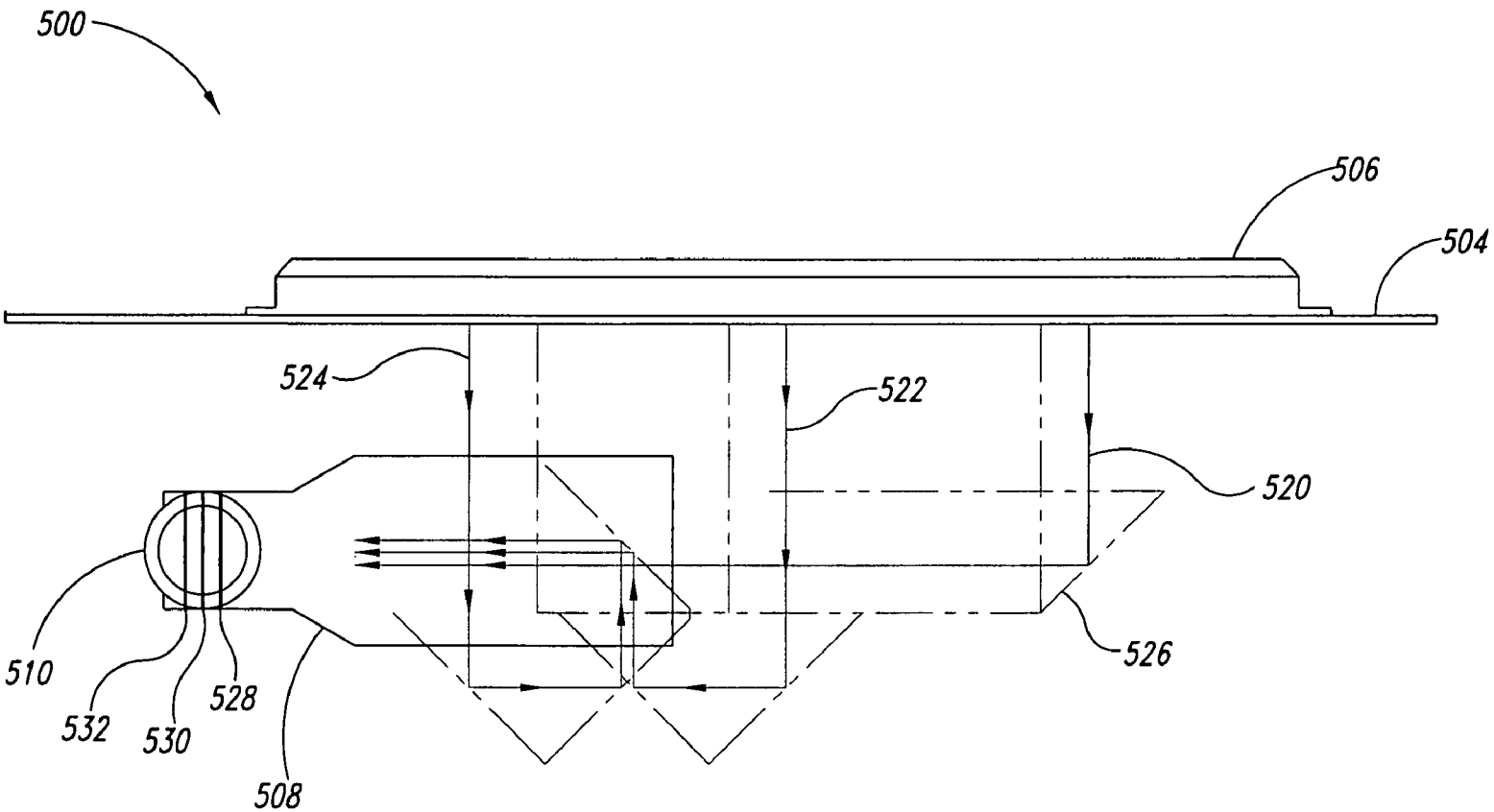
FIG. 15 is a schematic diagram of a prism assembly within the card hand-reader of FIG. 12 illustrating optical paths defined by the prism assembly.

FIG. 15 illustrates various optical ray paths 520, 522, and 524 reflected from the respective cards. The configuration of the respective mirrors 526, regardless as to whether the cards are staggered or not as shown in FIG. 13, permits the optical ray paths to focus on discreet regions of the image sensor 510, which receives each of the respective images 528, 530, 532. The images received by the image sensor 510 represent the machine-readable indicia 42 contained on at least two, but possibly each of the three cards located within the card hand-reader 500. Recall that in a game such as Baccarat, the minimum number of cards for a given hand may only be two cards, thus there would be no need to read a third card, however the card hand-reader 500 of the present embodiment is certainly capable of reading three cards, if not more if configured in such a manner. One skilled in the art will appreciate that the card hand-reader 500 may be further configured to read more than three cards.

Additionally and alternatively, although the placement of the cards 41 within the card hand-reader 500 shows the individual cards adjacently and proximately located and in the same plane with respect to each other, this configuration may be modified. For example, the cards do not necessarily have to be located within the same plane, for example the card hand-reader 500 may be curved to give it more aesthetic appeal. Further, the cards 42 may overlap as viewed by one or more of the gaming participants. As long as the human-readable symbols, which represent the rank of the card, for example Ace, King, Queen, etc., for each of the cards 41 in the hands 44, 46 are viewably exposed to wagering participants, then the configuration of the card hand-reader 500 is adequate.

Card Discard-Reader

The card discard-reader images the burn cards placed in a discard tray and may also read them. Once the burn cards have been successfully read, the discard reader may provide an indication to the dealer/caller 16 (FIG. 1) that the set of cards remaining within the card shoe-reader may be read.

Bet (Wager) Recognition Device

Figure 16:
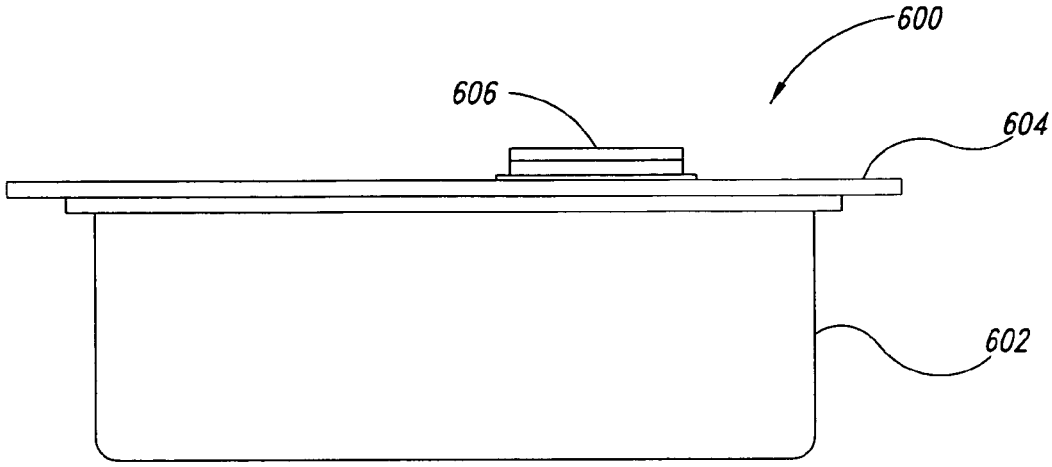
FIG. 16 is a side elevational view of a bet recognition device.
Figure 17:
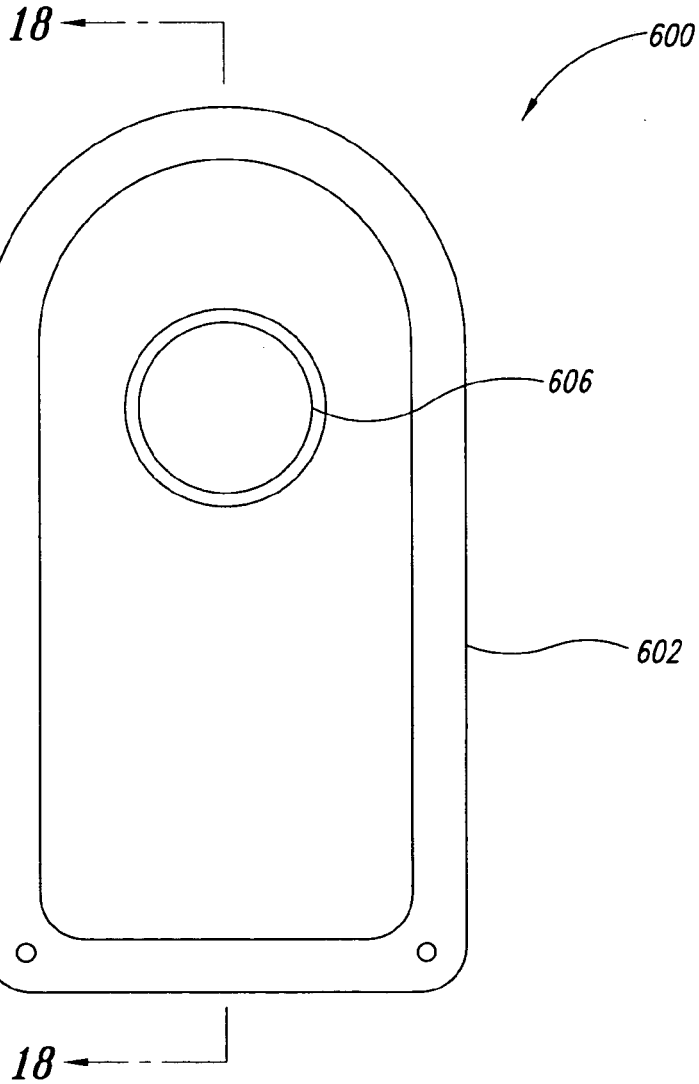
FIG. 17 is a top plan view of the bet recognition device of FIG. 16.

FIGS. 16-20 illustrate a bet recognition device 600 that may be incorporated into the gaming system 10 (FIG. 1) to identify, track, and verify wagers placed by the participants 14. FIGS. 16 and 17 illustrate that the bet recognition device 600 may have a housing 602, which contains at least some of the optical reading components, a table attachment flange 604, and a lens assembly cover 606. The lens assembly cover 606 may be clear, transparent, or made of a material that does not substantially impede the transmission of one or more wavelengths of light. The lens assembly cover 606 may protect the components located therein and also be configured in a variety of ways for cosmetic or aesthetic purposes.

Figure 18:
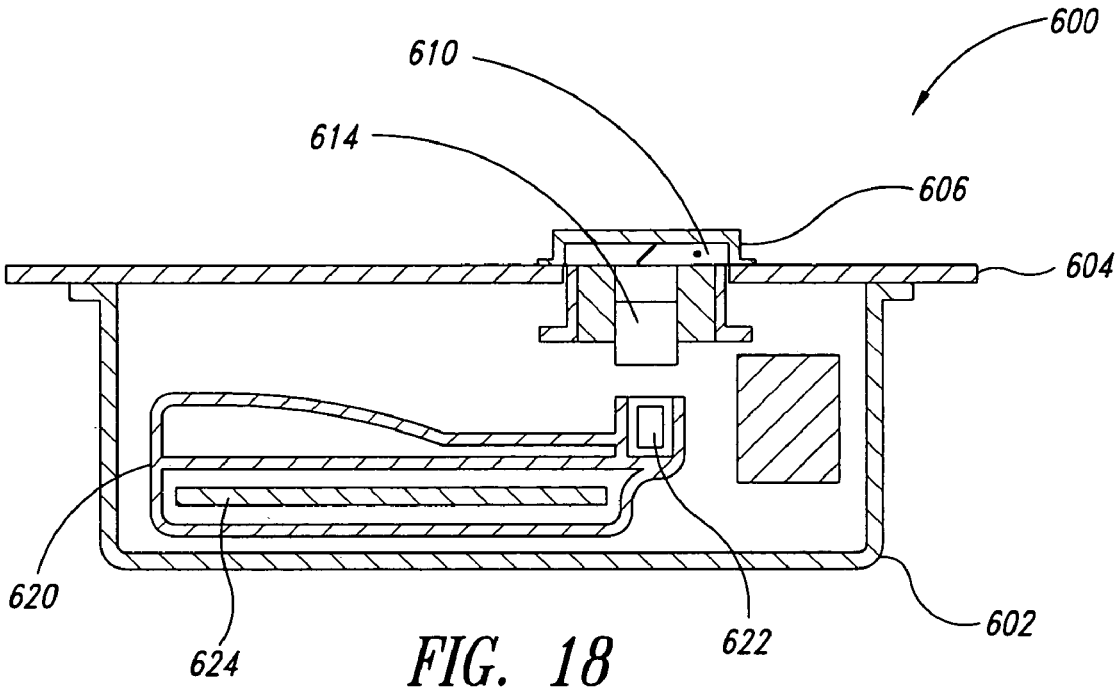
FIG. 18 is a cross-sectional view of the bet recognition device of FIG. 16 taken along section 18-18 of FIG. 17.

FIG. 18 is a cross-sectional view of the bet recognition device 600 illustrating some of the other components involved in capturing data from the participant's wagering chips. A lens assembly 608 (schematically illustrated in FIG. 18) may receive the image of a wager, which is discussed in more detail with reference to FIG. 20 below. The image may then be transmitted through a lens array 618 toward a CCD or CMOS type camera 620. The camera 620 can have a camera lens 622 electronically coupled to a printed circuit board 624.

Figure 19:
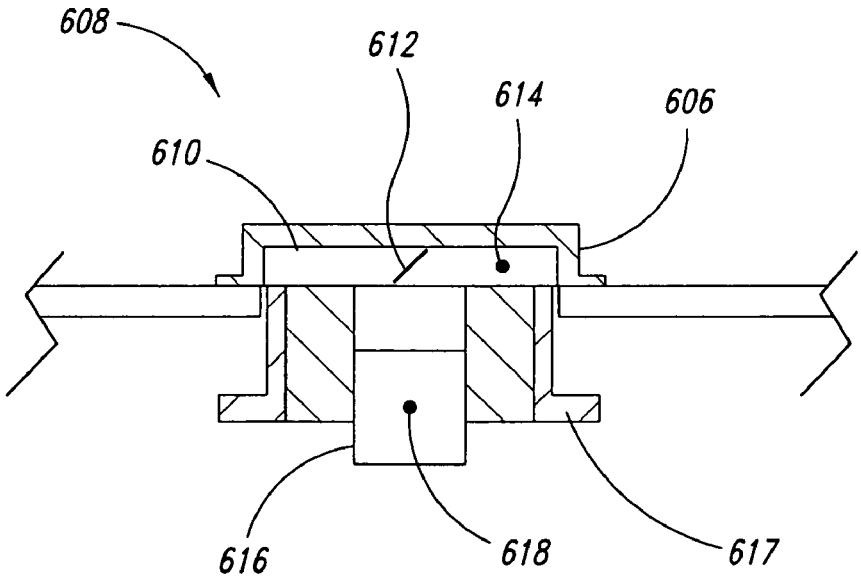
FIG. 19 is a close-up view showing a portion of the bet recognition device of FIG. 18.

FIG. 19 schematically illustrates one embodiment of the lens assembly 608, which can take the form of a clear or transparent circular member 610 with an embedded reflector 612 and an embedded infrared (IR) sensor 614. The circular member 610 may be rotationally coupled to a drive motor (not shown) through a shaft 617. One skilled in the art will appreciate that the rotational driving force for the circular member 610 may be mechanical or electromechanical, for example a programmed magnetic drive coupler, a step motor, or other rotational driving means 617 may control the rotation of the circular member 610. The circular member 610 can rotate through 360 degrees of rotation and can be capable of imaging over a range of at least 0 to 270 degrees. One skilled in the art will appreciate that this range may be broadened or narrowed depending on the configuration of the gaming table 12, the rate of rotation of the lens assembly 608, and the location of the bet recognition device 600 on the gaming table 12, among other things. Alternatively, the circular member 610 may be programmed to pivot back and forth over a specified, but more narrow range, depending on the context of how the bet recognition device is being utilized by the casino.

Figure 20:
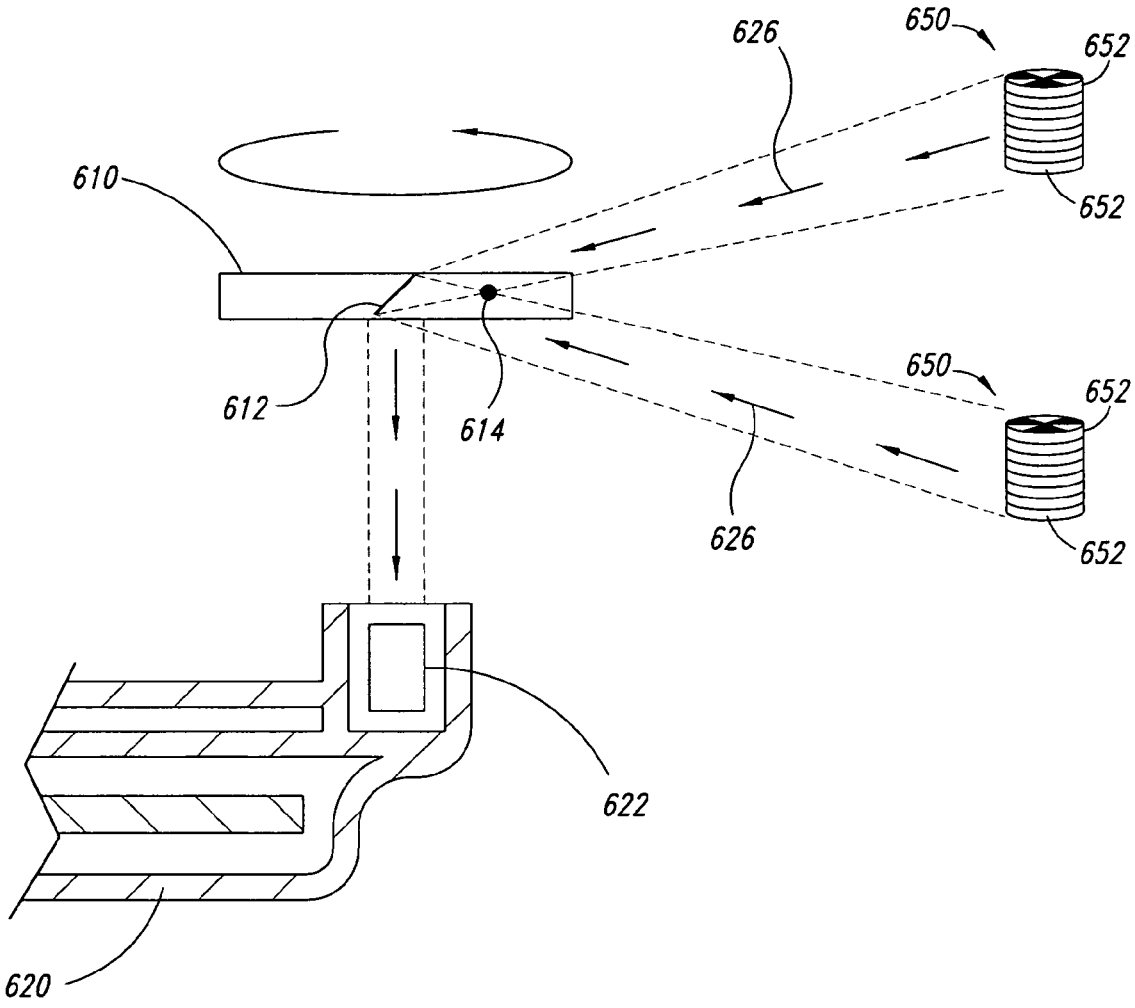
FIG. 20 is a schematic diagram illustrating a reflector of the bet recognition device of FIG. 18 directing an image to a camera lens.

FIG. 20 schematically illustrates the basic operation of the bet recognition device 600 according to the present embodiment discussed above in FIGS. 16-19. The bet recognition device 600 may be capable of sequentially capturing images 626 (e.g., a two dimensional array) of at least two stacks of chips 650 or even a single chip 652. The IR sensor 614 successively illuminates a stack of chips 650 or a single chip 652, respectively. The illuminated image 626 is received by the circular member 610 and thereby directed by the reflector 612 toward the camera lens 622. The image 626 may be pre-processed or decoded by the lens array 618, which may be embedded in an array housing 616, enroute to the camera lens 622.

Gaming System Operation

The general layout of a gaming system 10 is described above. The above devices, components, assemblies, etc. may be used in combination with each other or only a single item may be employed for a given gaming system 10. For example, in the game of Baccarat, the gaming system 10 may utilize a card shoe 24*a* or one of the embodiments of the card shoe-reader 24*b-e* and a card hand-reader 500; however, the card hand-reader 500 is not a necessary item if the card shoe-reader 24*b-e* is programmed to determine the game outcome based on the starting sequence and the rules of the game. As discussed above, card shoe-readers 24*b-e* can read a set of playing cards 40 to determine a starting or dealing sequence of the cards. For example, in the game of Baccarat, knowing the starting sequence in conjunction with the rules of Baccarat permits the casino to determine the outcome of every card game that can be played from the set of cards 40 within the card shoe-reader 24*b-e*. Therefore, as will be further detailed below, the gaming system 10 may be comprised with either a card shoe 24*a* or one of the card shoe-readers 24*b-e*.

Figure 21:
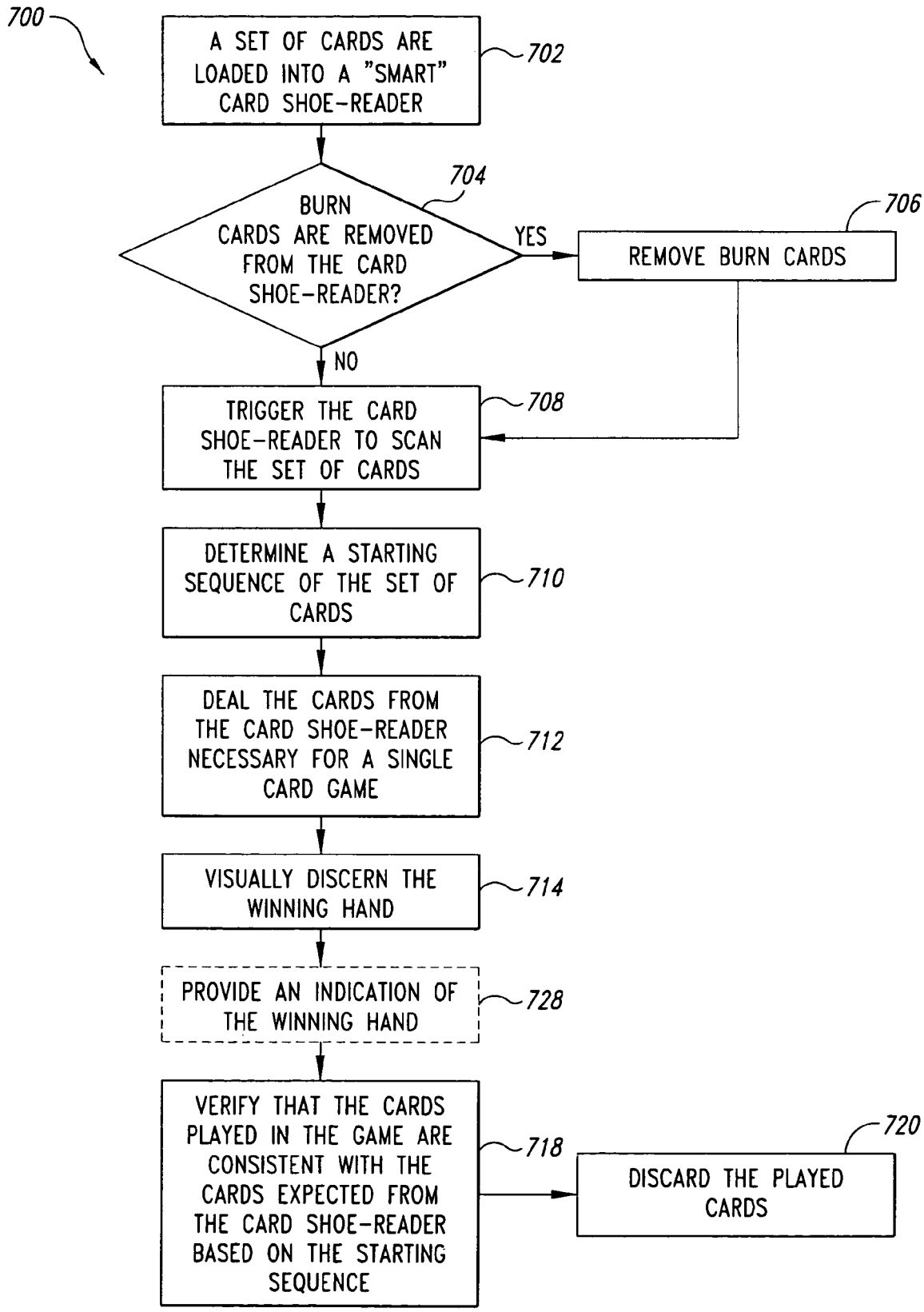
FIG. 21 is a flow chart showing a method of playing a card game with a card shoe-reader capable of determining a starting sequence of a set of playing cards according to one illustrated embodiment.

FIG. 21 illustrates one method of playing a card game 700, for example Baccarat using one of the card shoe-readers 24*b-e*, but no card hand-reader 500. In step 702, a set of cards 40 can be loaded into the card shoe-reader 24*b-e*. As previously noted, this step may be accomplished by a casino employee in an area of the casino away from the gaming table 12 or may be accomplished at the gaming table 12. In step 704, the dealer/caller 16 (FIG. 1) may burn cards from the card shoe-reader 24*b-e*. Typically, casinos have a standard policy to burn at least several cards from each card shoe-reader or deck of cards before game play commences from that particular reader or deck. If card are to be burned, then in step 706 the burn cards are removed from the card shoe-reader 24*b-e*. Next, in step 708, the card shoe-reader 24*b-e* may be triggered to read the set of cards 40. In step 710, the acquired data may be routed through a processor, for example, the computer 38 (FIG. 1) system having appropriate decoding and decryption software, to determine the starting sequence of the set of cards 40. As an alternative, the card shoe-reader 24*b-e* may have a second indicator (not shown) to display, either visually or audibly, a warning in the event that the attempt to read the set of cards 40 was unsuccessful. An unsuccessful read may occur due to damaged playing cards 41, cards that are stuck together within the card shoe-reader 2*bb-e*, or a host of other reasons. However, most of these issues could be easily and quickly remedied once the dealer/caller 16 is aware that an issue exists.

In step 712, after a successful read, the appropriate cards for constituting a single card game are removed from the card shoe-reader 24*b-e* according to a predetermined dealing sequence. In step 714, the playing hands, for example the first hand 44 and second hand 46, may be visually displayed to the gaming participants 14 at which time, based on the rules of the particular game being played, a winning hand or tie hand can be visually determined. In step 716, an optional indicator 140 (FIG. 6) may be actuated or displayed so that the gaming participants 14 can verify that the visually determined or announced outcome is consistent with the electronically determined outcome from step 710. In step 718, assuming that no indicator 140 was in use, the cards played during the game comprising the first hand 44 and the second hand 46, for example, may be verified against the electronically determined outcome acquired from the card shoe-reader 24*b-e*. Any discrepancies could be handled according to casino protocol. In step 720, the already distributed cards may be discarded so that a new card game can be dealt.

Figure 22:
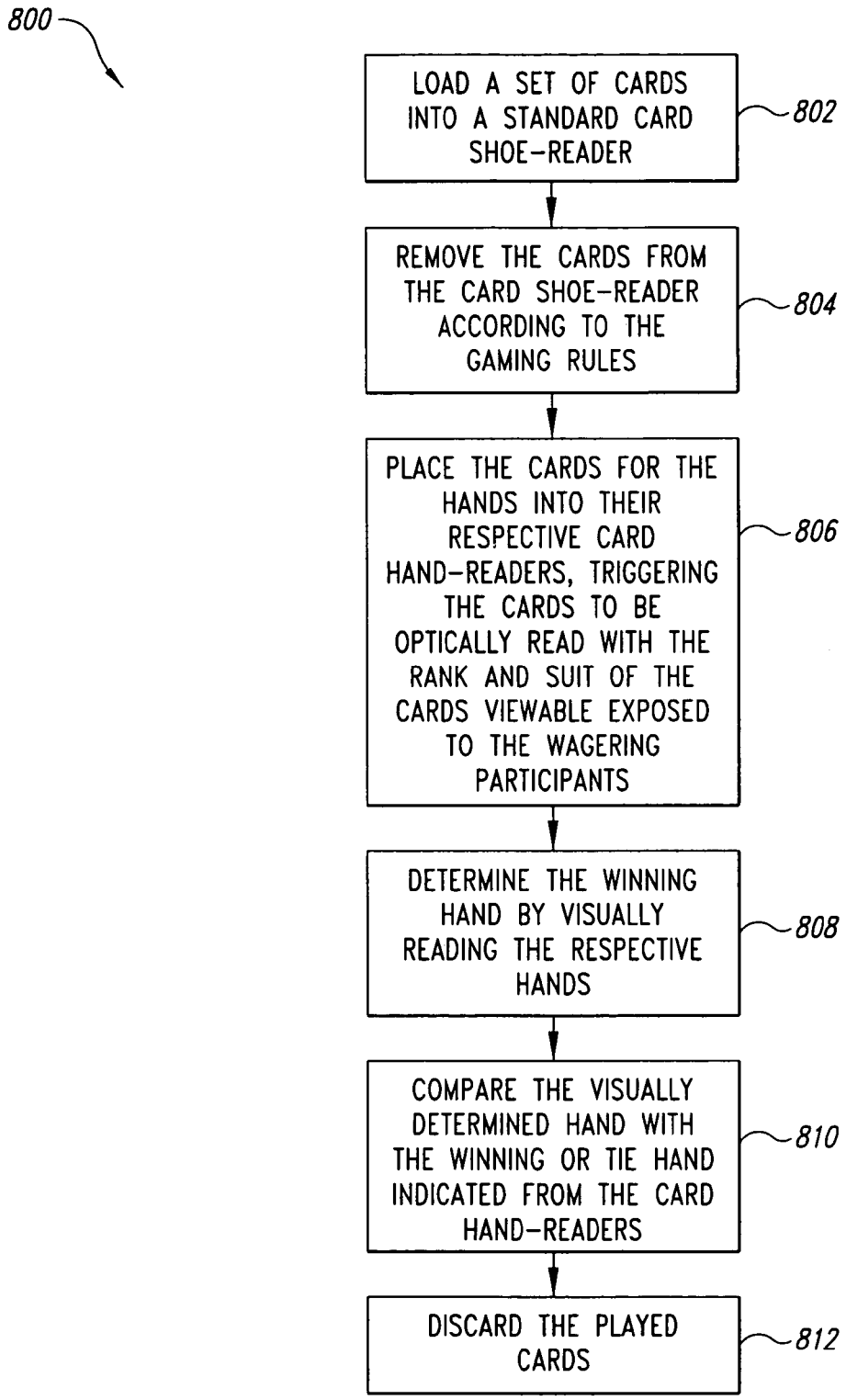
FIG. 22 is a flow chart showing a method of playing a card game with a card shoe-reader in combination with a card hand-reader according to another illustrated embodiment.

FIG. 22 illustrates another method of playing a card game 800, a card hand-reader 500 may be used in combination with a card shoe 24*a* or one of the other card shoe-readers 24*b-e*, the latter readers being capable of determining the outcome of a game based on reading the cards within the reader. For purposes of discussion, the card shoe 24*a* shoe-reader will be presumed, however one skilled in the art will appreciate the using any of the above components, devices, assemblies, etc. in combination with each other adds to the security, accuracy, and efficiency of the gaming system 10. In step 802, a set of cards 40 can be loaded into a card shoe 24*a*. In step 804, the cards for a first hand 44 and a second hand 46 may be removed from the card shoe 24*a* according to the gaming rules, for example the rules for Baccarat. In step 806, the cards comprising the respective hands may be placed into a single card hand-reader 500 configured to read both hands simultaneously, or individual card hand readers 500. The placement of the card into the card hand-reader can trigger the optical sensor to read the machine-readable symbol or symbols 42 on the respective cards. The machine-readable indicia 42 on the cards 41 can be optically read and decoded, thus creating an electronic record of the outcome of that particular card game. The placement of the cards into the card hand reader 500 is done such that the rank and possibly the suit (i.e., the face 58;

FIG. 4) of the cards are viewably exposed to the wagering participants 14 (FIG. 1). In Step 808, the winning or tie hand can be visually determined by at least one of the gaming participants 14. In Step 810, the visually determined winning or tie hand can be verified by comparison with the electronic output or indication from the card hand-reader 500. In Step 812, the played cards may be discarded in preparation for a new game to be dealt.

All of the above U.S. patents, U.S. patent application publications, U.S. patent applications, foreign patents, foreign patent applications and non-patent publications referred to in this specification and/or listed in the Application Data Sheet, including but not limited to U.S. patent application Ser. No. 10/017,276, filed Dec. 13, 2001, and entitled "METHOD, APPARATUS AND ARTICLE FOR RANDOM SEQUENCE GENERATION AND PLAYING CARD DISTRIBUTION;" U.S. patent application Ser. No. 10/360,846, filed Feb. 5, 2003, and entitled "METHOD, APPARATUS AND ARTICLE EMPLOYING MULTIPLE MACHINE-READABLE INDICIA ON PLAYING CARDS;" U.S. patent application Ser. No. 09/790,480, filed Feb. 21, 2001, and entitled "METHOD, APPARATUS AND ARTICLE FOR EVALUATING CARD GAMES, SUCH AS BLACKJACK;" U.S. patent application Ser. No. 09/849,456, filed May 4, 2001, and entitled "METHOD, APPARATUS AND ARTICLE FOR VERIFYING CARD GAMES, SUCH AS BLACKJACK;" and U.S. Provisional Application No. 60/500,898, filed Sep. 5, 2003, and entitled "SYSTEMS, METHODS, AND DEVICES FOR MONITORING CARD GAMES, SUCH AS BACCARAT" are incorporated herein by reference, in their entirety.

Although specific embodiments, and examples for, the invention are described herein for illustrative purposes, various equivalent modifications can be made without departing from the spirit and scope of the invention, as will be recognized by those skilled in the relevant art. The teachings provided herein of the invention can be applied to other systems for playing card games or developing card game systems, not necessarily the Baccarat gaming system 10 generally described above. For example, the teachings can employ networks, such as the Worldwide Web portion on the Internet, to interconnect the various described components. The various embodiments described above can be combined to provide further embodiments. For example, the illustrated methods can be combined, or performed successively. The illustrated methods can omit some acts, can add other acts, and can execute the acts in a different order than that illustrated to achieve the advantages of the invention.

These and other changes can be made to the invention in light of the above detailed description. In general, in the following claims, the terms used should not be construed to limit the invention to specific embodiments disclosed in the specification, but should be construed to include all computers, networks and card-reading and evaluation systems that operate in accordance with the claims. Accordingly, the invention is not limited by the disclosure, but instead its scope is to be determined entirely by the following claims.

We claim:

1. A method of operating a card identification system to evaluate card games played with a number of playing cards at a gaming table, the method comprising:

determining by the card identification system a starting sequence of the playing cards in a set of playing cards from which at least one card game will be dealt;

reading from each of a number of dealt playing cards forming a first hand dealt from the set of playing cards respective machine-readable identifying information with at least one playing card hand reader of the card identification system;

reading from each of a number of dealt playing cards forming a second hand dealt from the set of playing cards respective machine-readable identifying information with the at least one playing card hand reader;

automatically and independent of a knowledge the starting sequence, determining a respective identity of each of the number of dealt playing cards forming the first hand dealt from the set of playing cards based on identifying information read from the dealt playing cards forming the first hand;

automatically and independent of the knowledge the starting sequence, determining by the card identification system the respective identity of each of a number of dealt playing cards forming the second hand dealt from the set of playing cards based on identifying information read from dealt playing cards forming the second hand;

for each dealt playing card forming the first hand, automatically determining by the card identification system whether the respective identity determined independent of knowledge of the starting sequence of the respective dealt playing card matches a respective expected identity of a respective playing card expected to be in the first hand before any wagers are resolved, wherein an expectation of respective playing card to be in the first hand is based at least in part on the knowledge of the starting sequence; and for each dealt playing card forming the second hand, automatically determining by the card identification system whether the respective identity determined independent of knowledge of the starting sequence of the respective dealt playing card matches a respective expected identity of a respective playing card expected to be in the second hand before any wagers are resolved, wherein an expectation of respective playing card to be in the second hand is based at least in part on the knowledge of the starting sequence.

2. The method of claim 1 wherein determining by the card identification system a starting sequence of the playing cards in a set of playing cards from which at least one card game will be dealt comprises determining a sequence of a number of the playing cards in a card shoe before a first one of the number of playing cards is dealt.

3. The method of claim 1 wherein determining by the card identification system a starting sequence of the playing cards in a set of playing cards from which at least one card game will be dealt comprises determining the respective identity of each respective playing card as the respective playing card is dealt from a card shoe.

4. The method of claim 1 wherein determining by the card identification system a starting sequence of the playing cards in a set of playing cards from which at least one card game will be dealt comprises determining a respective identity of each of the playing cards in the set of playing cards before a card shoe holding the set of playing cards is placed on the gaming table and before any one of the playing cards of the set of playing cards is removed from the card shoe.

5. The method of claim 1 wherein determining by the card identification system a starting sequence of the playing cards in a set of playing cards from which at least one card game will be dealt comprises determining a respective identity of each of the playing cards in the set of playing cards after a card shoe holding the set of playing cards is placed on the gaming table.

6. The method of claim 1 wherein determining by the card identification system a starting sequence of the playing cards in a set of playing cards from which at least one card game will be dealt comprises one of optically imaging and optically scanning a respective identity symbol from each of at least a number of the playing cards in the set of playing cards.

7. The method of claim 1 wherein reading from each of a number of dealt playing cards forming a first hand dealt from the set of playing cards respective machine-readable identifying information with at least one playing card reader comprises reading a respective symbol from each of the playing cards forming the first hand while at least a portion of the first hand is inserted into the at least one playing card reader located on the gaming table and wherein reading from each of a number of dealt playing cards forming a second hand dealt from the set of playing cards respective machine-readable identifying information with the at least one playing card reader comprises reading a respective symbol from each of the playing cards forming the second hand while at least a portion of the second hand is inserted into the at least one playing card reader located on the gaming table.

8. The method of claim 1 wherein for at least one respective hand of the first hand or the second hand, automatically determining by the card identification system whether the respective identity of each dealt playing card forming the at least one respective hand matches a respective expected identity of a respective playing card expected to be in the at least one respective hand based at least in part on the knowledge of the starting sequence and based at least in part on the identifying information read from the dealt playing cards forming the second hand before any wagers are resolved further includes making the determination before a fourth card is dealt.

9. The method of claim 1 wherein for at least one respective hand of the first hand or the second hand, automatically determining by the card identification system whether the respective identity of each dealt playing card forming the at least one respective hand matches a respective expected identity of a respective playing card expected to be in the at least one respective hand based at least in part on the knowledge of the starting sequence and based at least in part on the identifying information read from the dealt playing cards forming the second hand before any wagers are resolved further includes making the determination before a last card is dealt.

10. The method of claim 1 wherein the playing card game is baccarat and automatically determining by the card identification system an identity of each of a number of playing cards forming a first hand dealt from the set of playing cards comprises determining the identity of at least two and less than four playing cards forming the first hand.

11. The method of claim 1 wherein reading from each of a number of dealt playing cards forming a first hand dealt from the set of playing cards respective machine-readable identifying information with at least one playing card reader comprises reading a respective machine-readable symbol from each of the playing cards forming the first hand while the first hand is at least partially inserted into a first playing card reader of the at least one playing card reader located on the gaming table and wherein reading from each of a number of dealt playing cards forming a second hand dealt from the set of playing cards respective machine-readable identifying information with the at least one playing card reader comprises reading a respective machine-readable symbol from each of the playing cards forming the second hand while the second hand is at least partially inserted into a second playing card reader of the at least one playing card reader located on the gaming table.

12. The method of claim 11 wherein reading the machine-readable symbol from each of the playing cards includes reading the machine-readable symbol from a portion of a backside of each of the playing cards.

13. The method of claim 11 wherein reading a respective machine-readable symbol from each of the playing cards forming at least one of the first hand or the second hand includes reading the respective machine-readable symbol from a respective portion of a respective front side of each respective one of the playing cards.

14. A gaming system for managing a card game played with playing cards from a set of playing cards, the gaming system comprising:

a card shoe from which playing cards having a respective machine-readable identifier may be dealt in a determined order;

a first card hand-reader separated from the card shoe and sized to receive therein a respective first portion of each of at least two dealt playing cards forming a first hand of playing cards while the at least two dealt playing cards are positioned such that at least a respective human-readable symbol carried on a respective face of at least a respective second portion of a respective playing card of the at least two playing cards is viewably exposed to a wagering participant, and to read the respective machine-readable identifier carried by each of the at least two dealt playing cards while the respective first portions of the at least two dealt playing cards are positioned in the first card hand-reader; and a processor communicatively coupled to receive identifying data from the first card hand-reader and configured to compare a respective determined identity of each of the at least two dealt playing cards in the first card hand-reader to at least one respective expected identity for a respective playing card expected to be included in the first hand of playing cards received by the first card hand-reader based on the determined order in which the playing cards are dealt from the card shoe.

15. The gaming system of claim 14 wherein the first card hand-reader comprises an optical reader positioned to read the respective machine-readable symbol carried by each of the at least two playing cards when the respective first portions of the at least two playing cards are received in the first hand reader while the second portion of the at least two playing cards including the first human-readable symbol is positioned outside of the first card hand-reader and is viewably exposed to one or more game participants.

16. The gaming system of claim 14 wherein the processor is further configured to decode the respective machine-readable identifiers.

17. The gaming system of claim 14 wherein the card shoe comprises a reader to read the respective machine-readable identifier from each of at least a number of the playing cards in the card shoe to determine the order.

18. The gaming system of claim 14, further comprising:

a gaming table comprising a playing surface including at least a Banker wagering region, a Player wagering region, and a Tie wagering region, wherein the card shoe and the first card hand-reader are separated by at least a portion of the playing surface; and a reader to read the respective machine-readable identifier from each of at least a number of the playing cards in the card shoe to determine the order, the reader installed in the gaming table and complementarily detachable with the card shoe.

19. The gaming system of claim 14 wherein the first card hand-reader comprises an optical reader positioned and configured to simultaneously read the respective machine-readable symbol carried by each of the at least two playing cards while the respective first portions of the at least two playing cards are received in the first card hand-reader and while the respective second portions of the at least two playing cards are positioned outside of the first card hand-reader to expose the first human-readable symbol to one or more game participants.

20. The gaming system of claim 14 wherein the first card hand-reader comprises an optical reader positioned to sequentially read the respective machine-readable symbol carried by each of the at least two playing cards while the respective first portions of the at least two playing cards are received in the first card hand-reader and while the respective second portions of each of the at least two playing cards are positioned outside of the first card hand-reader to expose each respective human-readable symbol to one or more game participants.

21. The gaming system of claim 14, further comprising:

a second card hand-reader sized to simultaneously receive a respective portion of each of at least two playing cards forming a second hand of playing cards while the at least two playing cards of the second hand of playing cards are each lying flat adjacent one another to expose at least a respective first human-readable symbol carried on a respective face of each of the respective playing cards, and to read the respective machine-readable identifier carried by each of the at least two playing cards of the second hand of playing cards while the at least two playing cards of the second hand of playing cards are received in the second card hand-reader.

22. The gaming system of claim 14, further comprising:

a card discard-reader sized to receive at least two hands of playing cards collected after resolving any wagers placed on the card game.

23. The gaming system of claim 14, further comprising:

at least one bet recognition device positioned on a playing surface to acquire data from at least two wager placements.

24. The gaming system of claim 14 wherein the processor is further configured to determine, independent of a knowledge of the determined order in which playing cards are dealt, a respective identity of each of the at least two dealt playing cards received by the first card hand-reader based on the received identity data.

25. A card identification system for evaluating an outcome of at least one card game, the card game played with a set of encoded playing cards, the system comprising:

a card shoe-reader sized to receive the set of playing cards;

an optical scanner communicatively coupled to the card shoe-reader for reading the set of encoded playing cards to determine a sequence of the set of playing cards;

a processor in communication with the card shoe-reader for evaluating the sequence of the set of playing cards based on a known dealing sequence and card game rules, the processor further configured to:

determine an outcome of each card game that can be played from the set of playing cards, identify each dealt playing card based on, and independent of knowledge of the dealing sequence, the respective identifying data read from each of the cards dealt from the set of playing cards, and verify that the playing cards comprising the first hand and second hand are consistent with the determined outcome based at least on the identification of the dealt playing cards and based at least on the knowledge of the dealing sequence;

an indicator in communication with the processor for indicating the outcome of the card game; and at least one card hand-reader to read identifying data from each of the playing cards dealt from the set of playing cards, the playing cards dealt from the set of playing cards forming a first hand and a second hand.

26. The system of claim 25 wherein the playing cards are encoded with a machine-readable indicia.

27. The system of claim 25 wherein the sequence of the set of playing cards is determined after at least one burn card has been removed from the set of playing cards.

28. The system of claim 25 wherein the indicator is connected to the card shoe-reader.

29. The system of claim 25 wherein the card game includes a Banker's hand and a Player's hand, each hand having at least two cards, but not more than three cards as determined by the card game rules.

30. The system of claim 28 wherein the indicator displays the outcome of the card game of Baccarat; the outcome being that either the Banker's hand wins, the Player's hand wins, or the Banker's hand ties with the Player's hand.

31. The system of claim 25 wherein the indicator is configured to display the outcome of the card game to at least one table participant.

* * * * *